US008640747B2

(12) United States Patent
Imai et al.

(10) Patent No.: US 8,640,747 B2
(45) Date of Patent: Feb. 4, 2014

(54) MEDICINE FILLING DEVICE

(75) Inventors: Takafumi Imai, Toyonaka (JP); Kazunori Tsukamoto, Toyonaka (JP); Fumitaka Hino, Toyonaka (JP)

(73) Assignee: Yuyama Mfg. Co., Ltd., Toyonaka-Shi (JP)

( * ) Notice: Subject to any disclaimer, the term of this patent is extended or adjusted under 35 U.S.C. 154(b) by 0 days.

(21) Appl. No.: 13/582,042

(22) PCT Filed: Feb. 25, 2011

(86) PCT No.: PCT/JP2011/054248

§ 371 (c)(1),
(2), (4) Date: Oct. 2, 2012

(87) PCT Pub. No.: WO2011/108447

PCT Pub. Date: Sep. 9, 2011

(65) Prior Publication Data

US 2013/0032247 A1 Feb. 7, 2013

(30) Foreign Application Priority Data

Mar. 3, 2010 (JP) ..... 2010-046404

(51) Int. Cl.
*B65B 43/42* (2006.01)
*B67C 3/00* (2006.01)

(52) U.S. Cl.
USPC ..... 141/165; 141/129; 141/168; 141/171

(58) Field of Classification Search
USPC ..... 141/103, 129, 144, 145, 165, 168, 171, 141/172, 237, 238, 283; 198/348, 463.1; 414/225.01, 226.02
See application file for complete search history.

(56) References Cited

U.S. PATENT DOCUMENTS

| | | | | |
|---|---|---|---|---|
| 6,421,584 | B1 * | 7/2002 | Norberg et al. | 700/242 |
| 7,703,637 | B2 * | 4/2010 | Michelli | 221/200 |
| 2004/0034447 | A1 * | 2/2004 | Vollm | 700/235 |
| 2009/0198208 | A1 * | 8/2009 | Stavsky et al. | 604/407 |
| 2011/0305545 | A1 * | 12/2011 | Davis et al. | 414/225.01 |
| 2012/0024423 | A1 * | 2/2012 | Imai et al. | 141/391 |
| 2013/0000260 | A1 * | 1/2013 | McErlean et al. | 53/492 |

FOREIGN PATENT DOCUMENTS

| | | |
|---|---|---|
| JP | 2004-142893 A | 5/2004 |
| JP | 2009-000291 A | 1/2009 |
| JP | 2009-022743 A | 2/2009 |

* cited by examiner

*Primary Examiner* — Timothy L Maust
*Assistant Examiner* — Brandon J Warner
(74) *Attorney, Agent, or Firm* — Masuvalley & Partners

(57) ABSTRACT

A medicine filling device for filling empty vials of different shapes and sizes with medicine without having to replace any members or having to perform any special operations is disclosed. More specifically, the medicine filling device is provided with a first transfer means to transfer an empty vial B stored within a stocker while the vial B is positioned on a side, a vial lifter (second transfer means) to hold the transferred vial B in an upright position and to move said vial B towards a medicine filling unit, and a vial orientation detection means to detect the orientation of the vial B which was removed from the stocker by the first transfer means. The first transfer means is provided with a reversal mechanism and the vial B is supplied to the vial lifter from the first transfer means while the bottom of the vial B faces a vial guiding means.

7 Claims, 16 Drawing Sheets

(a)

(b)

(a)

(b)

(c)

MEDICINE FILLING DEVICE

This application is a National Stage application under 35 U.S.C. §371 of International Application Ser. No. PCT/JP2011/054248, filed on Feb. 25, 2011, and claims the priority benefit under 35 U.S.C. §119 of Japanese Patent Application No. 2010-046404, filed on Mar. 3, 2010, which are hereby expressly incorporated by reference in their entirety for all purposes.

TECHNICAL FIELD

The present invention relates to a medicine filling device for filling medicine in vial bottles.

BACKGROUND ART

Conventionally, similar to a tablet filling device disclosed in Patent Document 1 below, a device is provided in which a vial bottle is moved from a stocker up to a predetermined filling position, and the medicine is filled into this. In this device, a vial bottle taken from the stocker can be transported by changing its posture to upright position with the opening orienting in the upper direction, and medicine can be filled. More specifically, in this tablet filling equipment, attention is paid to the fact that the center of gravity of a vial bottle is evenly distributed at its bottom side, and by allowing a vial bottle retrieved from the stocker to freely fall through an upright mechanism provided with chute or the like, its posture is changed such that the bottom is pointing downwards, and in this state the medicine is filled into the vial bottle.

RELATED ART DOCUMENTS

Patent Documents

Patent document 1: Japanese Patent Application Publication 2009-000291

SUMMARY OF THE INVENTION

Problem to be Solved by the Invention

When a configuration as in the conventional tablet filling equipment mentioned above is used, it is possible to supply a vial bottle with its bottom pointing downwards. On the other hand, as the size of chute or the like that constitute the upright mechanism was adjusted according to the size, shape and the like of the vial bottle, the options of usable sizes and shapes of a vial bottle were restricted, and thus there was a problem that the users may not be able to use vial bottles of their choice.

Based on such information, the present invention intends to provide a medicine filling device in which vial bottles for medicine filling can be used regardless of changes in their size and shape without the need for member change, special operation, or the like.

Means for Solving the Problem

A medicine filling device of the present invention that is provided for solving the above-mentioned problems includes: a bottle storage unit in which an empty vial bottle that is open on the top side and that has the bottom on a lower end can be stored randomly; a medicine filling unit for filling medicine in a vial bottle; a first transfer means that can transport an empty vial bottle, which was stored in the bottle storage unit, in an overturned state; a second transfer means that can maintain a vial bottle transported from the first transfer means in an upright state, and transport it toward the medicine filling unit; a bottle orientation detection means that can detect an orientation of a vial bottle taken out from the stocker to the first transfer means; and a reversal mechanism that can reverse an orientation of a vial bottle in the first transfer means based on a result of detection by the bottle orientation detection means, and wherein a vial bottle is supplied from the first transfer means to the second transfer means with a bottom oriented in a predetermined direction.

The medicine filling device of the present invention described above may include: a bottle guide means that is provided between the first transfer means and the second transfer means and that is capable of guiding a vial bottle, which was transported by the first transfer means, in an inclined downward direction; and a bottle mounting section provided in the second transfer means for mounting a vial bottle, and wherein a vial bottle may be supplied from the first transfer means to the second transfer means in a state in which a bottom is oriented towards a traveling direction in the first transfer means. It is preferable that the medicine filling device of the present invention have a configuration in which, in a process of moving a vial bottle to the second transfer means from the first transfer means by passing through the bottle guide means, after a vial bottle obliquely contacts a bottle mounting section of the second transfer means that is waiting in a predetermined standby position, the second transfer means moves in a lower side only by a predetermined amount from the standby position.

In addition, the medicine filling device of the present invention may also be provided with a bottle pressing means capable of pressing the body of a vial bottle, which is obliquely in contact with a bottle mounting section of the second transfer means that is waiting in a predetermined standby position, from the side, and a bottle receiving means capable of supporting a vial bottle pressed by the bottle pressing means in the side opposite to the bottle pressing means across the vial bottle. In case of such a configuration, it is preferable that in a process of moving a vial bottle to the second transfer means from the first transfer means by passing through the bottle guide means, after a vial bottle obliquely contacts a bottle mounting section of the second transfer means that is waiting in a predetermined standby position, the body of the vial bottle is pressed by the bottle pressing means.

Moreover, in the medicine filling device of the present invention, it is preferable that the second transfer means be provided with a plurality of clamping pieces that are capable of reciprocating movement in a path toward a center from an outer edge of a bottle mounting section, and wherein after a vial bottle is transported from the first transfer means to the bottle mounting section, the clamping pieces respectively move towards a center of the mounting section, and a vial bottle is gripped by the clamping pieces.

The medicine filling device of the present invention may also have a configuration in which the second transfer means is provided with a plurality of clamping pieces for gripping a vial bottle loaded on the bottle mounting section and a plurality of slits that guide the clamping pieces, and wherein the slit is formed such that a straight section extending toward a center in a width direction from an outer side in a width direction at an outer edge of the bottle mounting section, and a sloping section that is continuous with the straight section and that extends obliquely towards a center from an outer edge of the bottle mounting section become continuous.

The medicine filling device of the present invention may have a configuration in which an outer edge on the bottle guide means side in the bottle mounting section is provided with an inclined surface with which the bottom of a vial bottle descending via the bottle guide means can surface contact.

Further, the medicine filling device of the present invention may also have a configuration in which a second bottle orientation detection means that can detect the orientation of a vial bottle descending via the bottle guide means and in contact with the bottle mounting section is provided at a diagonally downward location with respect to a location where the bottle mounting section contacts a vial bottle, and wherein using an error status of detection operation by the second bottle orientation detection means as a criterion, the bottle mounting section is moved vertically only by a predetermined amount, and then the detection operation by the second bottle orientation detection means is executed again.

Effects of the Invention

In the medicine filling device of the present invention, because the randomly stored empty vial bottles are retrieved from a bottle storage unit and supplied, the orientation of the vial bottles is irregular at the time of the retrieval from the bottle storage unit by the first transfer means. However, in the medicine filling device of the present invention, by appropriately operating the reversal mechanism in accordance with the detection result by the bottle orientation detection means, it is possible to make the orientation of the vial bottles consistent and to supply them to the second transfer means. Therefore, the medicine filling device of the present invention can be used for filling of medicine regardless of the size and shape of a vial bottle without the need for member replacement, special operations or the like.

Here, taking into consideration of the fact that the posture of a vial bottle easily becomes unstable because a vial bottle conveyed by the first transfer means is empty, and there is a possibility of such as forcefully popping out to unexpected locations at the time of delivery to the second transfer means, the delivery of the vial bottle from the first transfer means to the second transfer means in the medicine filling device of the present invention is carried out in stages. Specifically, in the medicine filling device of the present invention, in the course of transferring a vial bottle from the first transfer means to the second transfer means, the vial bottle is guided by a bottle guide means such that the vial bottle is guided towards the lower side in an oblique direction with its bottom facing the downward direction. The vial bottle will be thus temporarily in contact with the bottle mounting section of the second transfer means that is waiting in a given standby position. With this, a vial bottle assumes a stable posture, and thus problems such as a vial bottle forcefully popping out to unexpected locations during delivery from the first transfer means to the second transfer means will not occur. Further, the second transfer means is moved in the lower side by a predetermined amount from the standby position after the vial bottle is stabilized as described above, and therefore, a vial bottle can be ensured to be in a standing state in the bottle mounting section.

In addition, when bottle pressing means and bottle receiving means are provided as described above, it becomes possible to press the body of a vial bottle, which is obliquely in contact with the bottle mounting section of the second transfer means, from the side by the bottle pressing means, and to catch the vial bottle by the bottle receiving means in the opposite side across the vial bottle to set the bottle in a standing state on the bottle mounting section.

In the medicine filling device of the present invention, the second transfer means is provided with a plurality of clamping pieces capable of reciprocating motion in the path from the outer edge of the bottle mounting section toward the center, and after a vial bottle is transferred from the first transfer means to the bottle mounting section, the respective clamping pieces move to the center of the bottle mounting section, and therefore, the vial bottle will be gripped by the clamping pieces. Therefore, according to the medicine filling device of the present invention, regardless of the size or the like of the vial bottle, the vial bottle can be firmly gripped by the clamping pieces.

In the medicine filling device of the present invention, by providing a straight section and an oblique section to the slits that guide the clamping pieces as described above, it becomes possible to firmly grasp an even larger vial bottle by the clamping pieces.

Further, in the medicine filling device of the present invention, by having a configuration of providing an inclined surface in the outer edge on the above-mentioned bottle guide means side in the bottle mounting section as described above, and making the bottom of a vial bottle that is falling through the bottle guide means to contact with this inclined surface, it becomes possible to firmly catch the vial bottle that is falling through the bottle guide means.

In the medicine filling device of the present invention, by providing a second bottle orientation detection means, which can detect the orientation of a vial bottle that is in contact with the bottle mounting section, in a diagonally downward location with respect to the point where the bottle mounting section and the vial bottle contact with each other, it becomes all the more possible to ensure whether or not a vial bottle that was dispatched to bottle mounting section is being supplied with its bottom facing the downward direction. Moreover, by vertically moving the bottle mounting section only by a given amount using the error in detection operation by the second bottle orientation detection means as a criterion, and then by re-executing the detection operation of the second bottle orientation detection means, it becomes possible to further improve the detection accuracy of the orientation of a vial bottle by the second bottle orientation detection means.

DETAILED DESCRIPTION OF EMBODIMENTS

Figure 1:
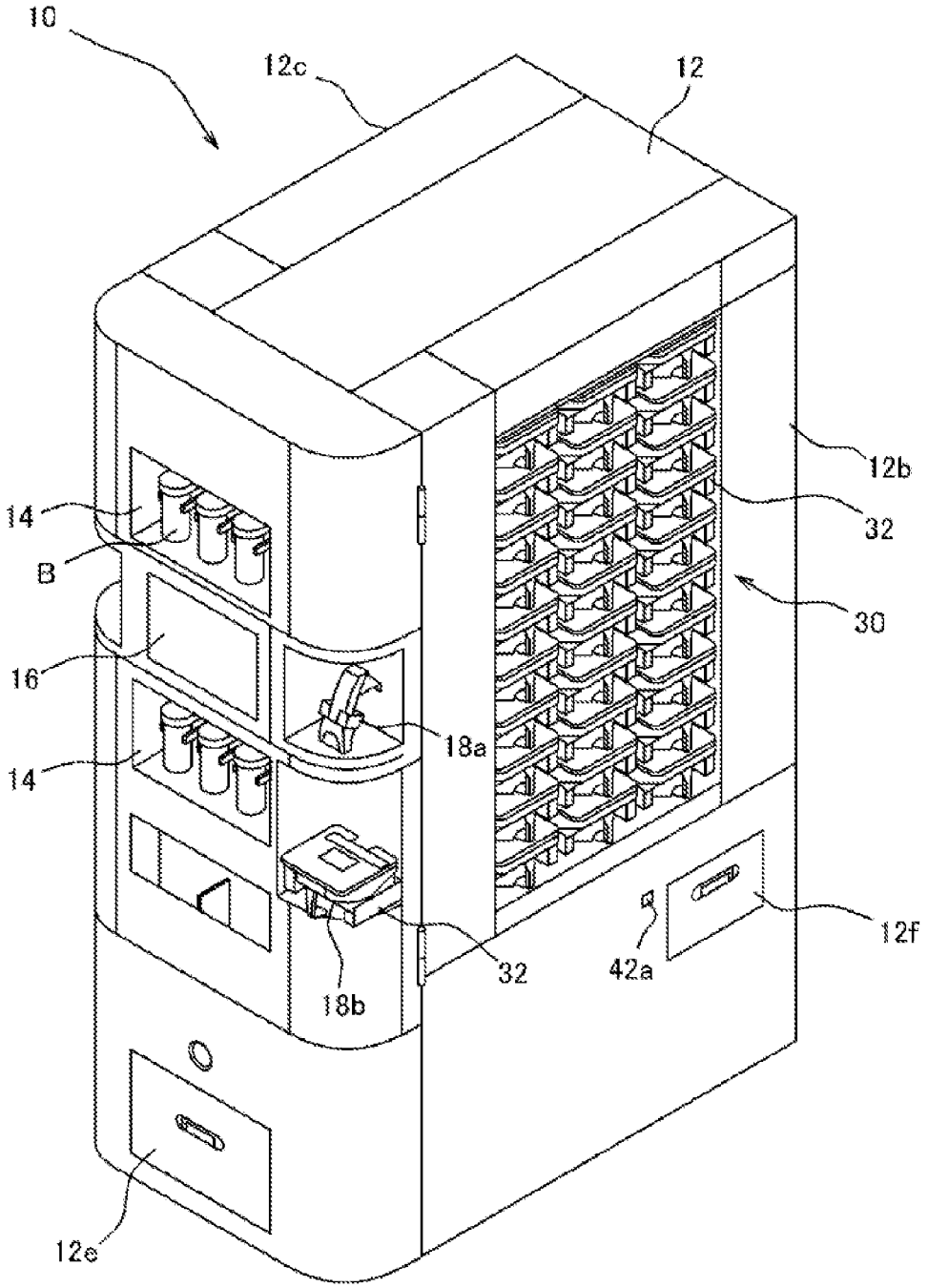
FIG. 1 is a perspective view of a medicine filling device provided in one embodiment of the present invention.
Figure 3:
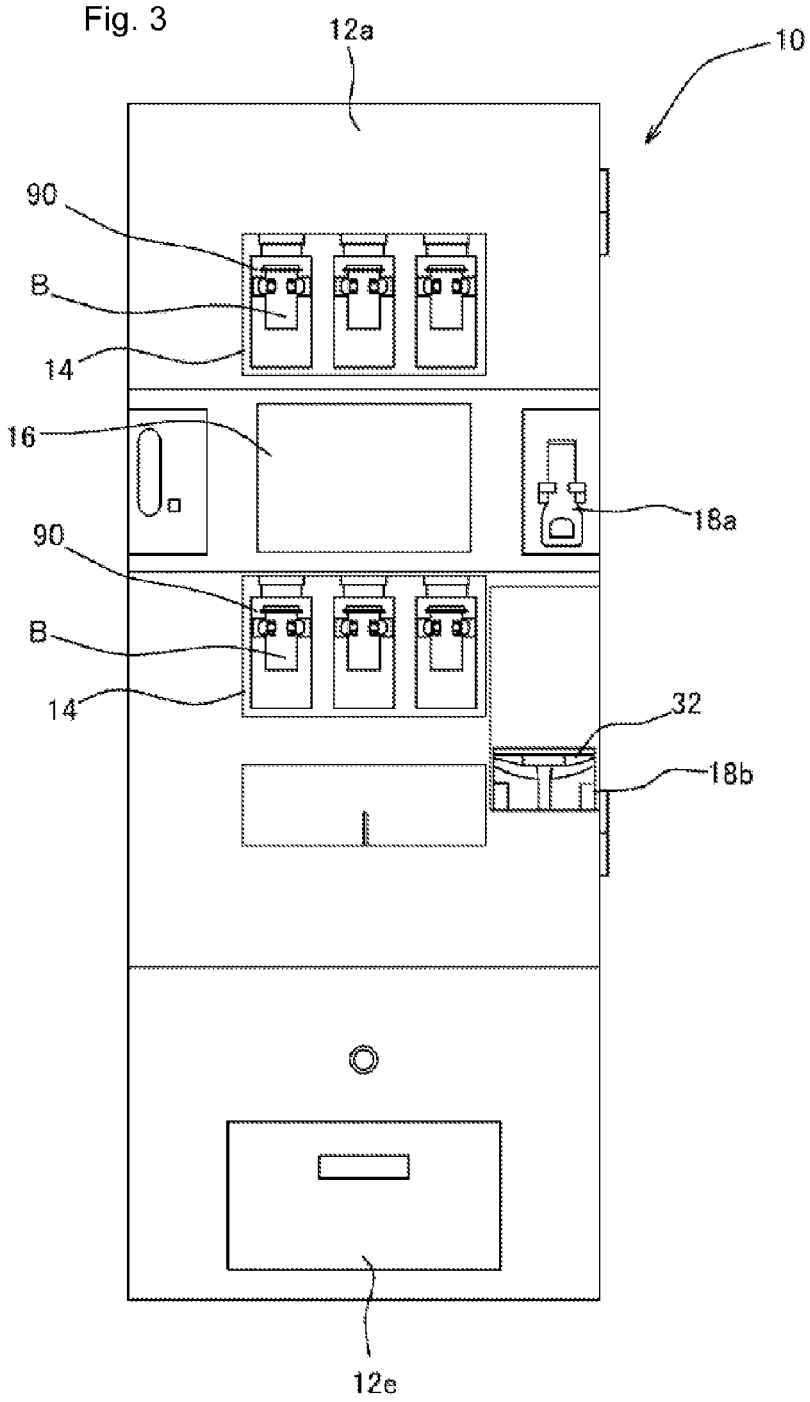
FIG. 3 is a front view of the medicine filling device shown in FIG. 1.
Figure 6:
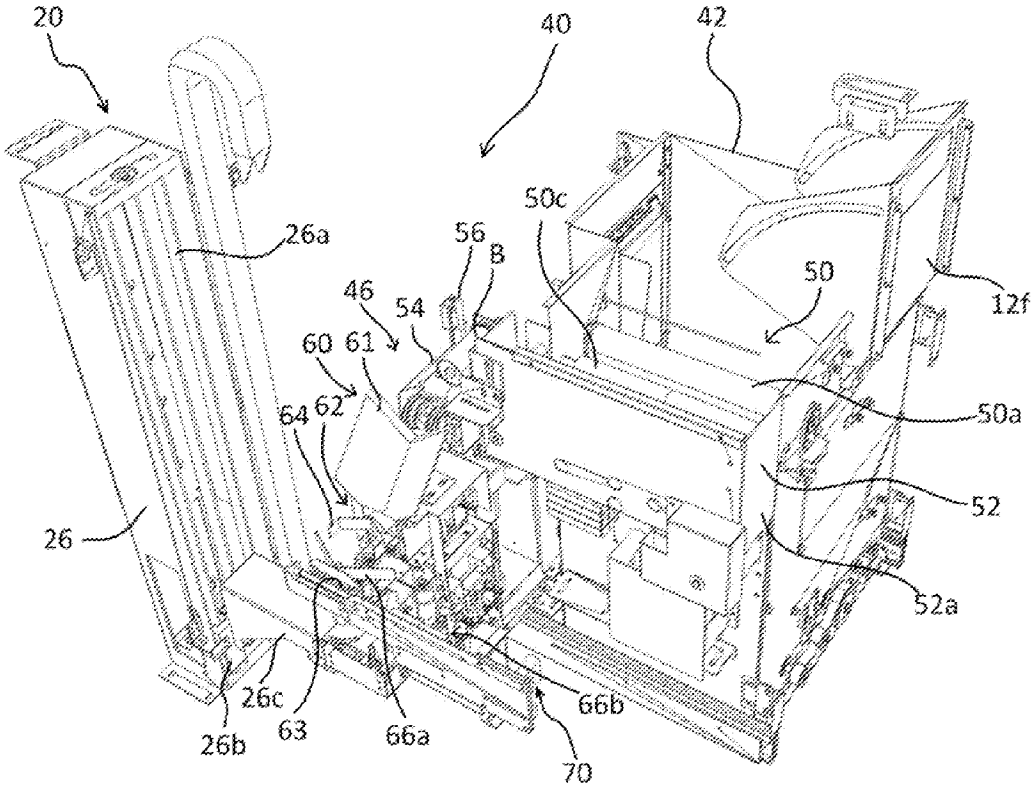
FIG. 6 is a perspective view of vial bottle feeding unit, vial bottle lifter, and the structure in their vicinity in the medicine filling device shown in FIG. 1.

In continuation, a medicine filling device 10 provided in one embodiment of the present invention will be explained in detail while referring to diagrams. The medicine filling device 10 is a device for filling and supplying tablets (medicine) in vial bottles B. As shown in FIG. 1 and FIG. 3, in the front side 12*a* of the device body 12 of the medicine filling device 10 is provided with extraction windows 14*a* to 14*c* for extracting the vial bottles B filled with medicine, the operating panel 16, bar code reader 18*a*, and a working bench 18*b* and the like. A pull out door 12*e* is also provided in the lower side of the front side 12*a*. As shown in FIG. 6, a labeling unit 70 is integrally provided with the pull out door 12*e*. Therefore, by pulling the pull out door 12*e*, the labeling unit 70 that is built in the device body 12 can be pulled out from the front side 12*a*.

Figure 2:
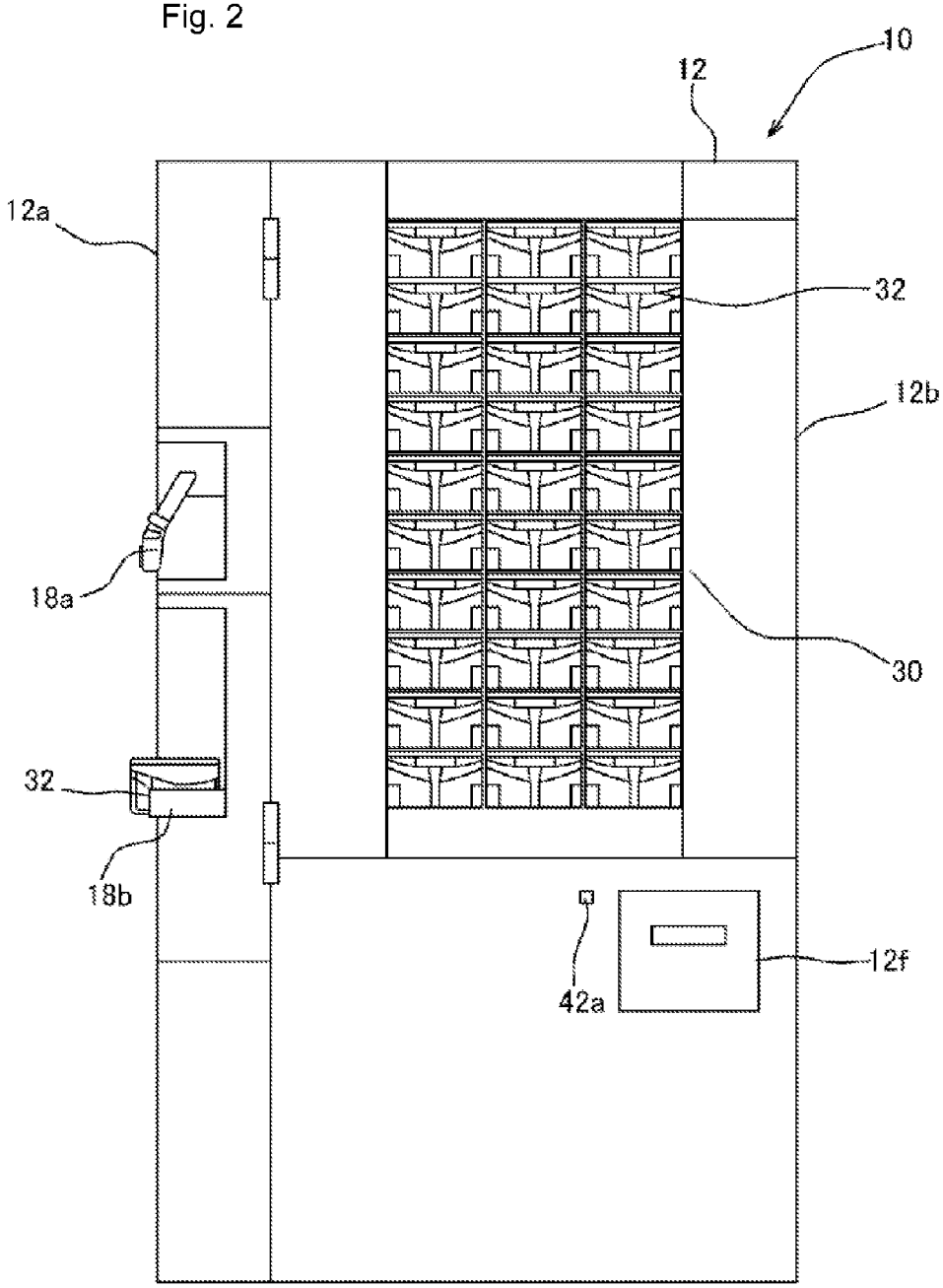
FIG. 2 is a side view of the medicine filling device shown in FIG. 1.

As shown in FIG. 1 and FIG. 2, a multiple tablet cassettes 32 constituting the tablet supply unit 30 (medicine filling unit), described later, are attached to the device body 12, and can be freely attached or taken out from the side surfaces 12*b* and 12*c*. In the side surfaces 12*b* and 12*c*, the bottle pull out door 12*f* is provided, and by opening this door, it is possible to replenish and store the vial bottles B randomly in the vial bottle supply unit 40 (see FIG. 5 and FIG. 8), described later.

Figure 4:
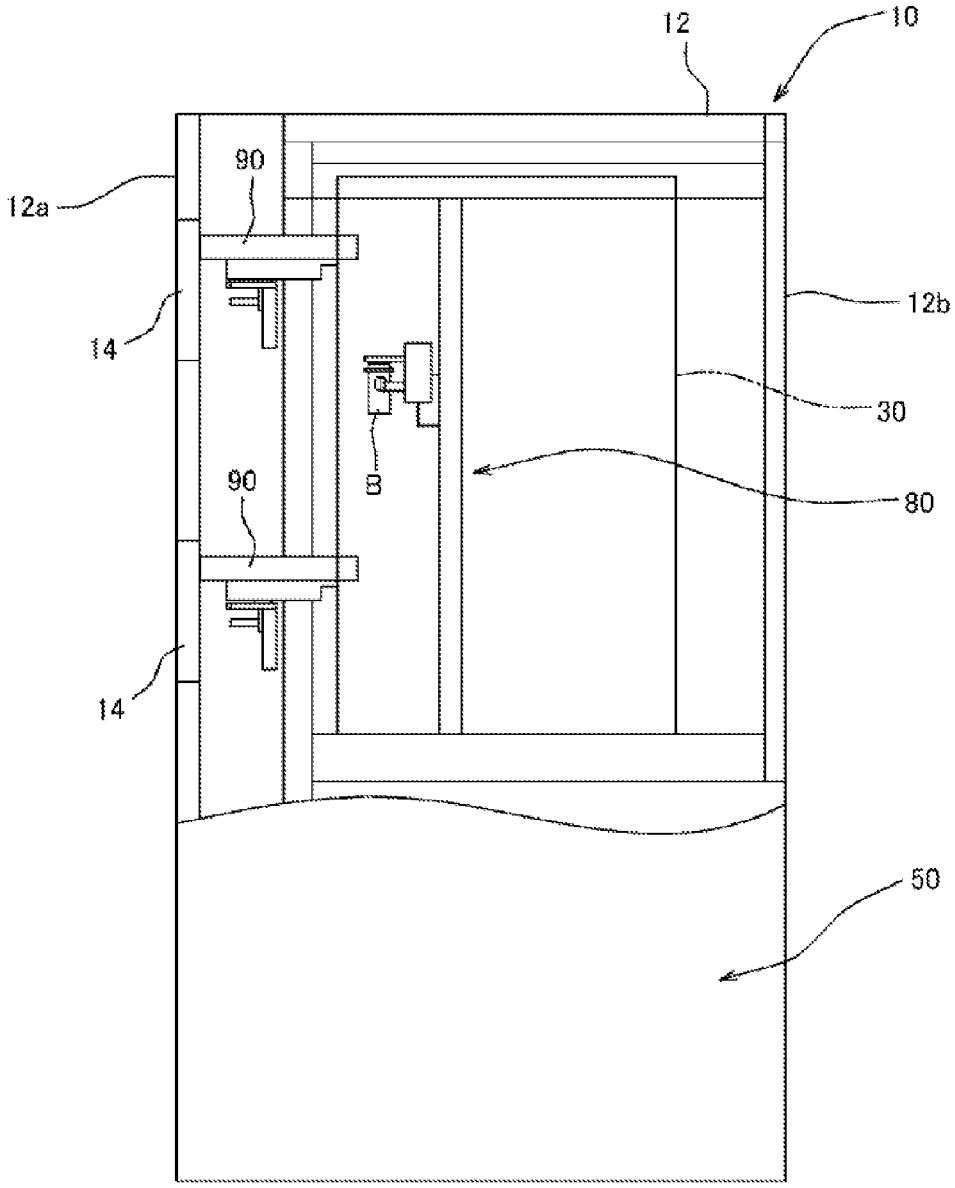
FIG. 4 is a side view showing the internal structure of the medicine filling device shown in FIG. 1.
Figure 5:
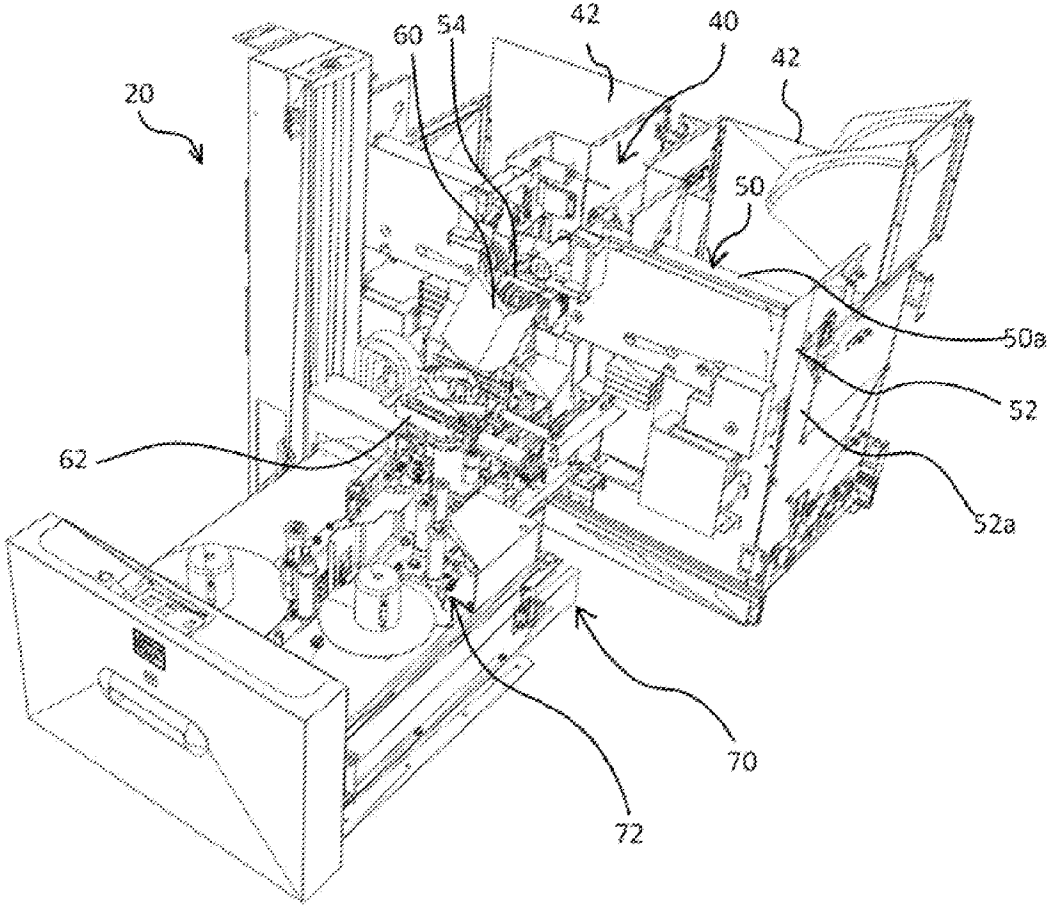
FIG. 5 is a perspective view of vial bottle feeding unit and labeling unit, vial bottle lifter, and the structure in their vicinity in the medicine filling device shown in FIG. 1.

As shown in FIG. 5, provided in the inside of the lower side of the device body 12 of the medicine filling device 10 are a vial bottle lifter 20 (second transfer means), a vial bottle supply unit 40 and a labeling unit 70. As shown in FIG. 4, at the top of the device body 12 is provided with a transporting unit 80 for transporting the vial bottle B readied in the lower side to the tablet supply unit 30, and a discharge unit 90 to discharge a vial bottle B filled with medicine by the tablet supply unit 30 towards the user. The configuration of the various parts is further described below.

Figure 9:
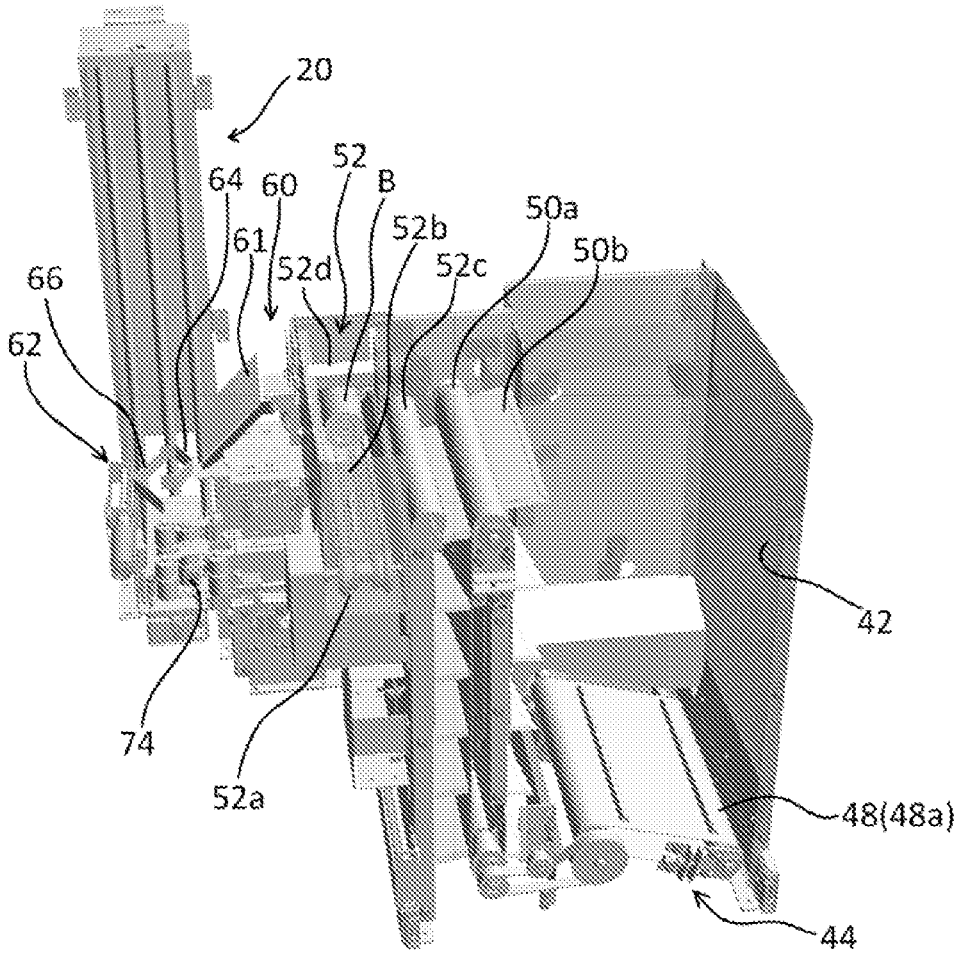
FIG. 9 is a perspective view of vial bottle feeding unit, vial bottle lifter, and the structure in their vicinity wherein a part of the cover has been removed in the medicine filling device shown in FIG. 1.

As shown in FIG. 5, FIG. 6, and FIG. 9, the vial bottle supply unit 40 is provided with stockers 42, a retrieval mechanism section 44 and a delivery mechanism section 46. Stocker 42 is a cuboidal box provided for stocking the vial bottles B. The stockers 42 are installed in a position that is a lower side of sides 12*b* and 12*c* of the device body 12 and that is on the rear side 12*d*. Vial bottles B loaded via the bottle pull out door 12*f* can be randomly stored in the stocker 42.

In addition, the medicine filling device 10 of this embodiment allows pulling out of the respective stockers 42 and 42 themselves to the side 12*b* or 12*c* of the device body 12. Moreover, pull out release buttons 42*a* and 42*a* are provided on sides 12*b* and 12*c* respectively. The pull out release buttons 42*a* and 42*a* are intended for releasing a stopper (not illustrated) that is provided for limiting the pull out operation of the stockers 42 and 42 respectively from the device body 12. By pressing the pull out release buttons 42*a* and 42*a*, it is possible to pull out the stockers 42 and 42 from the device body 12. The pull out release buttons 42*a*, 42*a* shall be luminous with a built-in light-emitting diode (LED) or the like, and shall have the feature of notifying whether it is possible to release the stopper mentioned above. Specifically, the pull out release button 42*a* is OFF when the stocker 42 can be pulled out (normal state). Also, the pull out release button 42*a* starts flashing if pressed in a state where it is not good to pull out the stocker 42 (pull out prohibited state) because the inner devices are operating or the like, and it will be in ON state when the pull out subsequently becomes possible (pull out possible state).

Here, as mentioned above, because the vial bottles B are housed randomly inside the stocker 42, it is desirable to prevent occurrence of a phenomenon such as a bridge being formed by the vial bottles B, which may result in a discharge problem of the vial bottles B or erroneous detection of stock status of the vial bottles B. Therefore, in order to prevent a problem occurring due to the formation of a bridge by the vial bottles B, in the medicine filling device 10 of this embodiment, as shown in FIG. 7, baffle members 43 of appropriate shapes are disposed at various spots inside the stocker 42, specifically at the corners or on the inner wall surface of the stocker 42.

Figure 7:
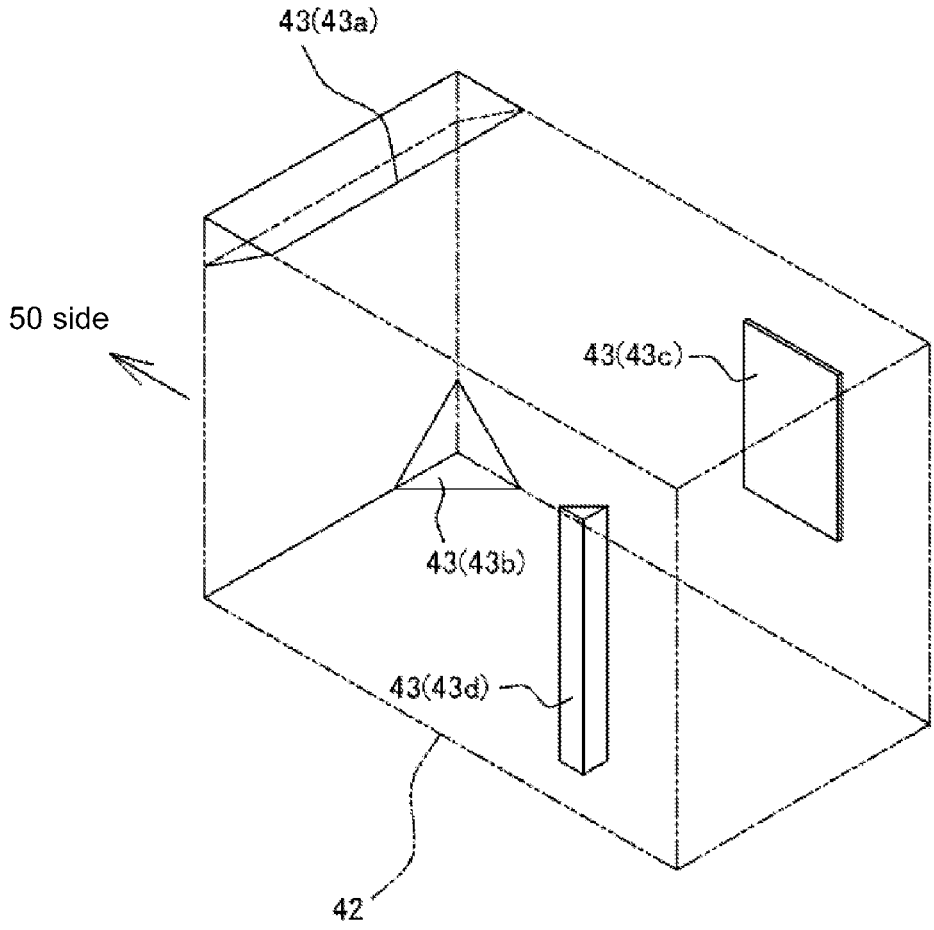
FIG. 7 is a perspective view of the schematic showing the arrangement of the baffle members in the stocker.

To be more explicit, a configuration is possible wherein the baffle members 43*a* to 43*d* are provided inside the stocker 42 as shown in FIG. 7. In the example of FIG. 7, in case the vial bottles B are jammed up till top of the stocker 42, the baffle member 43*a* is intended to play the role of returning the upright standing vial bottles to inside the stocker. The baffle member 43*a* has an appearance of a triangular column, and is provided in the upper end on the extraction means 24 side in the stocker 42 so as to cross the width direction of the stocker 42 (in a direction roughly parallel to the paddle 50*b*). The baffle member 43*b* is an inclined plate provided in the corner on the draw out means 50 side in the stocker 42, and when the quantity of the vial bottles B remaining in stocker 42 becomes small, it performs the function of redeploying a vial bottle B that has become perpendicular with respect to paddle 50*b* to prevent the vial bottles B from idling. The baffle members 43*c* and 43*d* are plates provided for preventing multiple vial bottles B extending in a row and jamming in the width direction (in a direction roughly parallel to the paddle 50*b*) of the stocker 42, that is, forming the so-called bridge state. The baffle member 43*c* is constituted from a resin plate, and the baffle member 43*d* is constituted of triangular pillar shaped resin. The baffle members 43 (43*a* to 43*d*) may be formed by any material and shape, but it is desirable that they are formed by a material and in a shape such that the vial bottles B will slide easily without getting entangled.

The extraction mechanism section 44 is provided to draw out vial bottles B that have been randomly loaded in the stocker 42, and as shown in FIG. 9, provided with conveyor 48, draw out means 50 and transportation means 52. The conveyor 48 is configured of an endless belt 48*a*. The conveyor 48 is installed at the bottom of the stocker 42 such that it is inclined in the upper direction towards the front side 12*a* of the device body 12. Therefore, by operating the conveyor 48, it is possible to move the vial bottles B contained in the stocker 42 to the left side of the space (the side of front side 12*a*) in FIG. 9.

The draw out means 50 is intended for carrying the vial bottles B collected in the front side 12*a* by the conveyor 48 in the stocker 42, and drawing them out from the stocker 42. The draw out means 50 is made of a drivable endless belt 50*a* with paddles 50*b* formed at fixed intervals, and is installed vertically along the inner wall of the front side of stocker 42. Therefore, when the draw out means 50 is operated, each paddle 50*b* moves sequentially in the upper direction while maintaining a horizontal posture. With the paddles 50*b* moving in the upper direction, the vial bottles B in the front side 12*a* of the stocker 42 are carried up, and retrieved from stocker 42.

In addition, the draw out means 50 is provided with an auxiliary roller 50*c*. Auxiliary roller 50*c* is configured of a free roller provided at approximately the same height as the location of the top end of the endless belt 50*a*. The auxiliary roller 50*c* is interposed between the endless belt 50*a* and transportation means 52 (described later). With the existence of the auxiliary roller 50*c*, a vial bottle B that was carried up by paddles 50*b*, even if a size of which is assumed to be small for the sake of argument, will not clog in gaps or the like and smoothly transported towards the transportation means 52.

The transportation means 52 is intended for transporting a vial bottle B retrieved by the draw out means 50 towards the delivery mechanism section 46. As shown in FIG. 9, the transportation means 52 includes a frame 52*a* and a transportation conveyor 52*b*. Frame 52*a* is attached along the upper end on the front side 12*a* of the stocker 42, and the section on the stocker 42 side is open to facilitate acceptance of a vial bottle B retrieved by the draw out means 50. Further, a guide 52*c* is provided in the frame 52*a* for preventing the popping out of vial bottle B that was extracted from the draw out means 50.

A transportation conveyor 52*b* is attached to the frame 52*a* described above. The transportation conveyor 52*b* is installed such that the endless belt 52*e* constituting the transportation surface faces the top end of the stocker 42 via the open section of frame 52*a*. By operating the endless belt 52*e* by a power source (not shown), the transportation conveyor 52*b* can dispatch a vial bottle B towards the delivery mechanism section 46.

Figure 15:
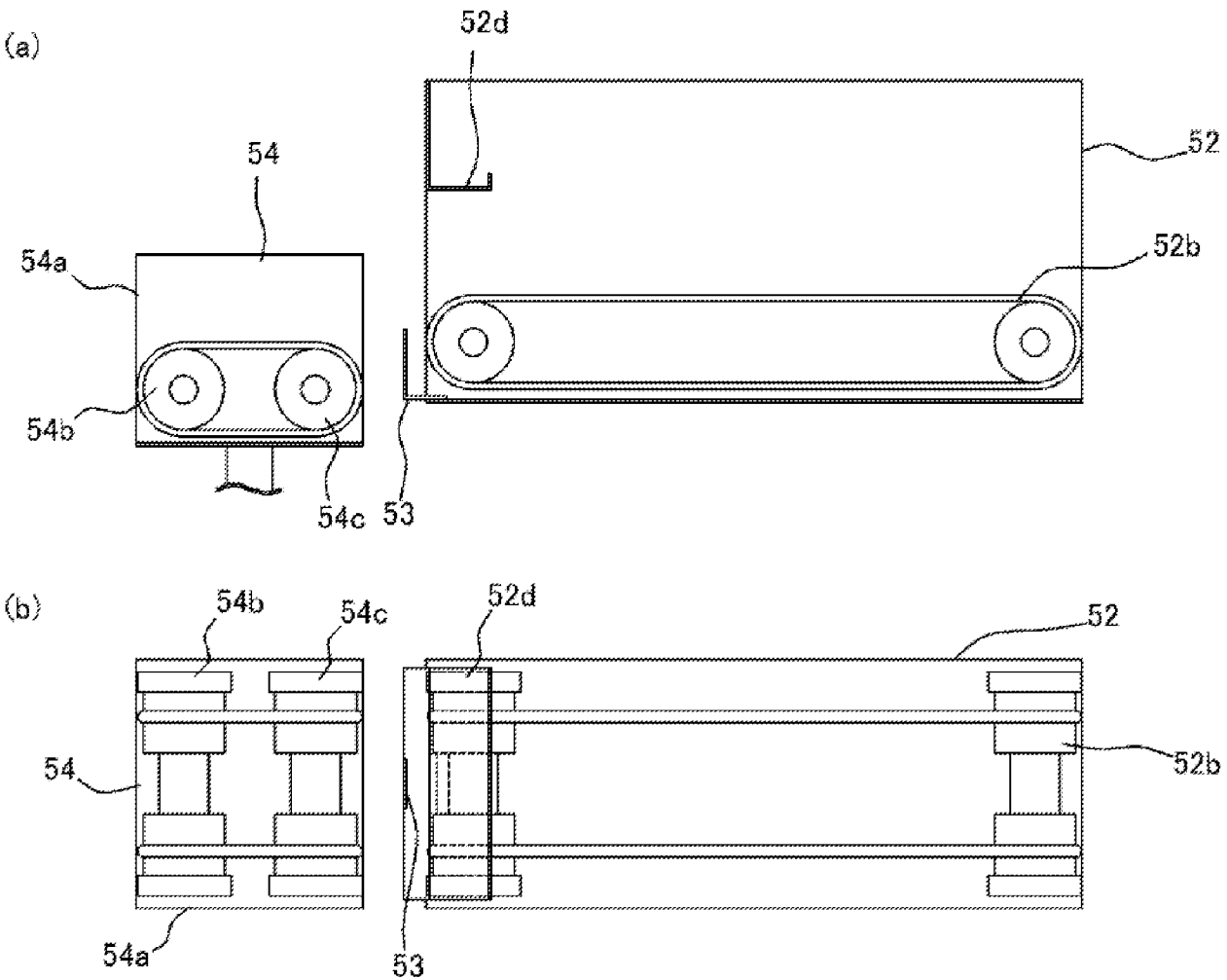
FIG. 15 (*a*) is an explanatory view showing a state as seen from the front of the transportation means and the first transfer means, and (b) is an explanatory view showing a state as seen from the top surface of the transportation means and the first transfer means shown in (a).

A colliding piece 52*d* described above is provided in a location in the downstream side of the transportation direction of the transportation conveyor 52*b*. The colliding piece 52*d* is a member having a roughly "L" shaped cross-section as shown in FIG. 15, and is installed at a position that is higher by just H than the transportation surface of the transportation conveyor 52*b* formed by the endless belt 52*e*. This height H is higher than the outer diameter DR of the vial bottle B, but is lower than the height of the vial bottle B. Therefore, even if it is assumed that the vial bottle B was in upright posture at the instant when it was transferred from the draw out means 50 to the transportation conveyor 52*b*, the vial bottle B normally collides with the colliding piece 52*d* in the downstream end of the transportation conveyor 52*b*, and is transported in a fallen state to the delivery mechanism section 46.

As shown in FIG. 15, because the transportation surface of the transportation conveyor 52*b* is installed at somewhat higher location than the first transfer means 54 constituting the delivery mechanism section 46 described later, it may be thought that during the movement from the transportation conveyor 52*b* to the first transfer means 54, the vial bottle B tends to lean forward (rise at the bottom) towards the first transfer means 54, and this phenomenon tends to occur easily especially when using a large size vial bottle B. In order to smoothly move the vial bottle B to the first transfer means 54 from the transportation conveyor 52*b*, it is desirable that the vial bottle B will not lean forward (rise at the bottom) excessively. In the present embodiment, because the colliding piece 52*d* as described above is provided, the vial bottle B does not lean forward (rise at the bottom) excessively when transferring from the transportation conveyor 52*b* to the first transfer means 54, and is smoothly transferred.

Further, due to the fact that the transportation surface of the transportation conveyor 52*b* is provided at a position slightly higher than the first transfer means 54 (described later), it may also be expected that the vial bottle B may be stuck in the gap that is provided for rotation of the first transfer means 54 between the transportation conveyor 52*b* and the first transfer means 54, and the portion of the vial bottle B at the front in the traveling direction may rise higher than the part at the rear (the so-called wheelie state). Such a phenomenon is more likely to occur particularly when a smaller size vial bottle B is used. In order to prevent such a phenomenon, in this embodiment, as shown in FIG. 15, a push-up piece 53 is provided in the gap formed between the first transfer means 54 and the transportation conveyor 52*b* so as to rise upward from the lower side. Therefore, at a time of transfer from the transportation conveyor 52*b* to the first transfer means 54, the vial bottle B is pushed up (supported) from the lower side by the push-up piece 53, and thus it is possible to prevent the vial bottle B from getting stuck in the gap mentioned above.

The delivery mechanism section 46 is a part provided with a unique configuration in the medicine filling device 10, and is designed for turning the vial bottle B, which was transported in an overturned state by the transportation means 52 of the extraction mechanism section 44 described above, into a standing position and handing over to the next process. The delivery mechanism section 46 is provided almost in the center of the width direction of the device body 12, and can hand over the vial bottle B drawn out from any of the stocker 42 of the side surface 12*c* side and the stocker 42 of the side surface 12*d* side (not shown and omitted in FIG. 6 and FIG. 9) to the next process. The delivery mechanism section 46 has a configuration including the first transfer means 54, the bottle orientation detection means 56, reversal mechanism 58, bottle guide means 60 and bottle upright means 62 (see FIG. 9. Omitted in FIG. 8)

The first transfer means 54 is provided at a position adjacent in the width direction center side of the device body 12 to the transportation conveyor 52*b* mentioned above. The first transfer means 54 has a structure wherein the endless belt 54*d* is wound between a pair of pulleys 54*b*, 54*c* that are mounted at predetermined intervals in the frame 54*a*. Also, the first transfer means 54 has a structure wherein the frame 54*a* can be rotated by the reversal mechanism 58 provided in the lower direction to change the transportation direction of the vial bottle B.

Figure 8:
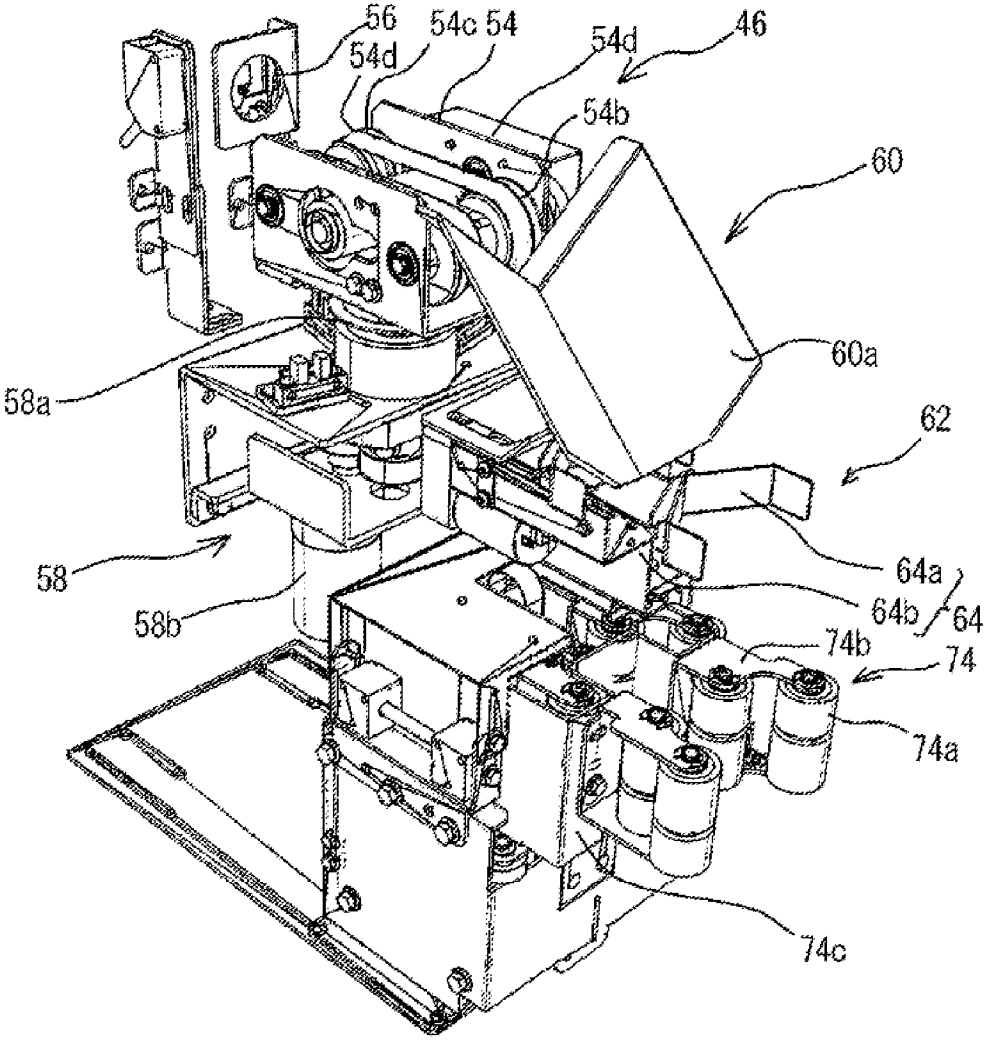
FIG. 8 is a perspective view of a delivery mechanism section and the structure in its vicinity in the medicine filling device shown in FIG. 1.
Figure 13:
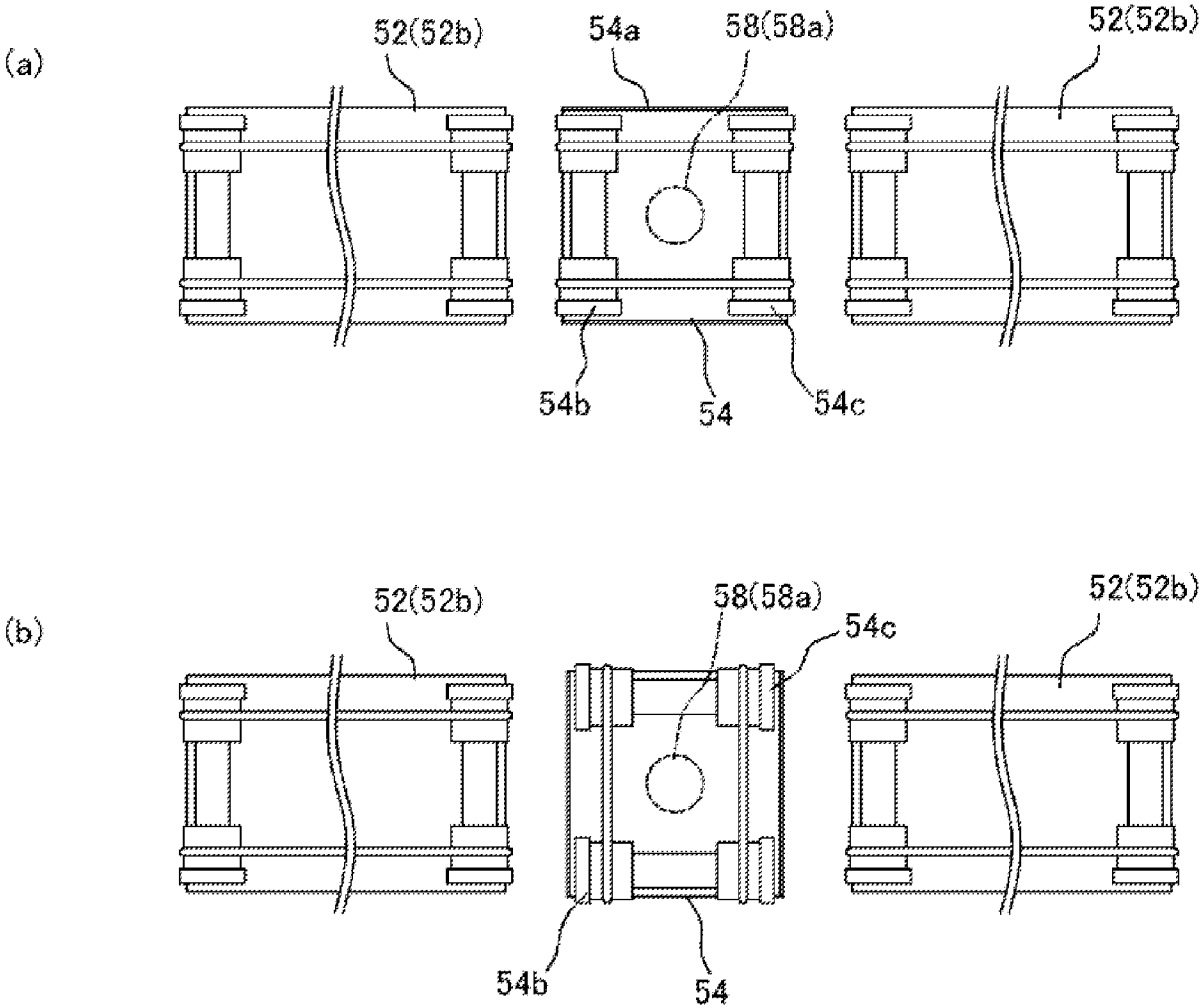
FIG. 13 is an explanatory diagram showing the schematic of a transportation means and a first transfer means, (a) is an explanatory diagram illustrating the first transfer means in the receiving state, and (b) is an explanatory diagram illustrating the state of first dispatch.

Specifically, as shown in FIG. 8, the reversal mechanism 58 is provided with a rotating shaft 58*a* that is installed so as to extend in a vertical direction, and a power source 58*b* for rotating the rotating shaft 58*a*. The rotating shaft 58*a* is connected to approximately the center of the bottom side of the frame 54*a*. By operating the reversal mechanism 58, as shown in FIG. 13(*a*), the first transfer means 54 can adjust the direction of the frame 54*a* so that a vial bottle B can be moved in roughly the same direction as the transportation direction of the vial bottle B in the transportation conveyor 52*b* (hereinafter also referred to as "acceptance state"). In addition, As shown in FIG. 13(*b*), by operating the reversal mechanism 58 and rotating by approximately 90° around the rotating shaft

58*a*, the first transfer means 54 can achieve a state such that the pulley 54*b* is oriented towards the front side 12*a*, and the pulley 54*c* is oriented towards the rear side 12*d* (hereafter also referred to as "first dispatch state"). By having the first dispatch state, the vial bottle B can be moved toward vial bottle lifter 20. The first transfer means 54 can achieve a state wherein the orientation of the first transfer means 54 is inverted from the first dispatch state by rotating the frame 54*a* by approximately 180° around the rotating shaft 58*a*, that is, a state wherein the pulley 54*b* orients towards the rear side 12*d* and the pulley 54*c* is oriented towards the front side 12*a* (hereafter also referred to as "second dispatch state"). By switching from the first dispatch state to the second dispatch state, the orientation of the vial bottle B mounted on the first transfer means 54 can be inverted.

The bottle orientation detection means 56 is provided at the rear side of the device body 12 with respect to the first transfer means 54 described above, that is, in a location opposite to the bottle guide means 60 described later. The bottle orientation detection means 56 is configured of a sensor that can detect the bottom of the vial bottle B, and it is possible to detect whether or not the bottom of the vial bottle B mounted on the first transfer means 54 is orienting in the direction of the bottle guide means 60.

The detection result of the bottle orientation detection means 56 is used as a criterion for inferring whether or not to operate the reversal mechanism 58 in the delivery mechanism section 46. That is, the delivery mechanism section 46 can detect the orientation of the vial bottle B mounted on the first transfer means 54 in the first dispatch state by the bottle orientation detection means 56, suitably operate the reversal mechanism 58 based on the detection result, and dispatch the vial bottle B such that the bottom orients towards bottle guide means 60. Specifically, if the vial bottle B is mounted with the bottom already oriented towards the bottle guide means 60 in the first dispatch state, the reversal mechanism 58 does not operate, and the vial bottle B is dispatched as is towards the bottle guide means 60. On the other hand, if the bottom of the vial bottle B is oriented in a direction opposite (towards bottle orientation detection means 56) to the bottle guide means 60 in the first dispatch state, the reversal mechanism 58 is operated, the first transfer means 54 is rotated by approximately 180°, and the vial bottle B is dispatched to the bottle guide means 60 after it is changed to an inverted state (second dispatch state). In this way, the delivery mechanism section 46 can always dispatch the vial bottle B in a fixed posture to the vial bottle lifter 20. In this embodiment, in order to improve the detection accuracy of the bottle orientation detection means 56, it is possible to implement an operation wherein, after mounting the vial bottle B on the first transfer means 54 and rotating by 90°, the vial bottle B is moved towards the bottle orientation detection means 56 (direction opposite to bottle guide means 60), and the vial bottle B is practically brought into contact with the bottle orientation detection means 56.

As shown in FIG. 5 to FIG. 9, the bottle guide means 60 includes a sloping guide 61 formed by bending a metal plate, a bottle upright means 62, a bottle detection means 63, and the like. The sloping guide 61 is roughly in the shape of 'V', and is installed between the above-mentioned first transfer means 54 and the vial bottle lifter 20 (second transfer means). The bottle guide means 60 is attached in an inclined state in a downward direction toward the vial bottle lifter 20, so that it is possible to slide down the vial bottle B towards the vial bottle lifter 20 from the first transfer means 54.

As shown in FIG. 5 to FIG. 9, the bottle upright means 62 is intended to set a vial bottle B, which is in an inclined state on the lifting table 22 of the vial bottle lifter 20 after being guided by the sloping guide 61, to an upright state. The bottle upright means 62 is provided with a bottle pressing means 64 and bottle receiving means 66 (the bottle receiving means 66 is not shown and omitted in FIG. 8). The bottle pressing means 64 is provided with a pressing piece 64*a* and a drive mechanism 64*b*, and is installed at a level lower than the first transfer means 54 and the sloping guide 61 described above. The pressing piece 64*a* is formed by bending a metal plate so as to follow the shape of the body of the vial bottle B. The drive mechanism 64*b* is meant for reciprocating the pressing piece 64*a* so as to approach and move away from the bottle receiving means 66 (described later).

Figure 11:
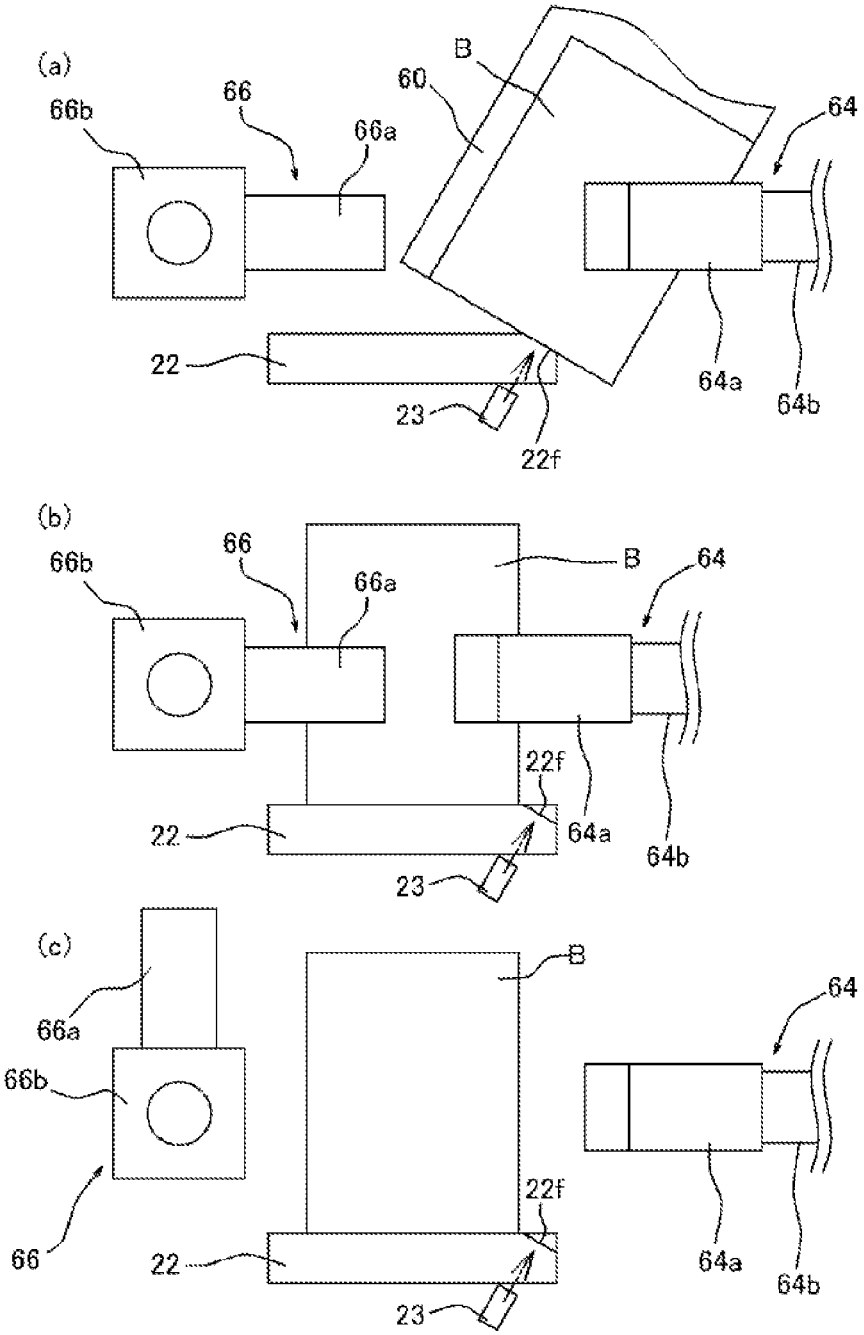
FIG. 11 is an explanatory diagram showing the schematic of the operation of transferring a vial bottle to a lifting table.

The bottle receiving means 66 is intended for supporting the body of the vial bottle B, which is pressed by the bottle pressing means 64, from a direction opposite to the bottle pressing means 64, and catching the vial bottle B. As shown in FIG. 6 and FIG. 11, the bottle receiving means 66 is arranged in a location facing the bottle pressing means 64 by providing predetermined gaps. The bottle receiving means 66 includes a bottle receiving unit 66*a* formed by bending a metal plate and a receiving unit driving means 66*b* for rotating the bottle receiving unit 66*a*. The bottle receiving unit 66*a* is pivotally supported by the motor 66*c* constituting the receiving unit driving means 66*b*. By operating the motor 66*c*, the posture of the bottle receiving means 66 can be switched between a state wherein the bottle receiving unit 66*a* is approximately horizontal (see FIG. 6, FIG. 11(*a*) and (*b*) etc.) and a state wherein the bottle receiving unit 66*a* is lifted upward (see FIG. 11(*c*)). When the bottle receiving unit 66*a* is substantially horizontal, it will be facing the bottle pressing means 64 mentioned above. When the bottle receiving unit 66*a* is in the lifted state, the lifting table 22 of the vial bottle lifter 20 will be able to move vertically in the space between the bottle pressing means 64 and bottle receiving means 66.

Figure 10:
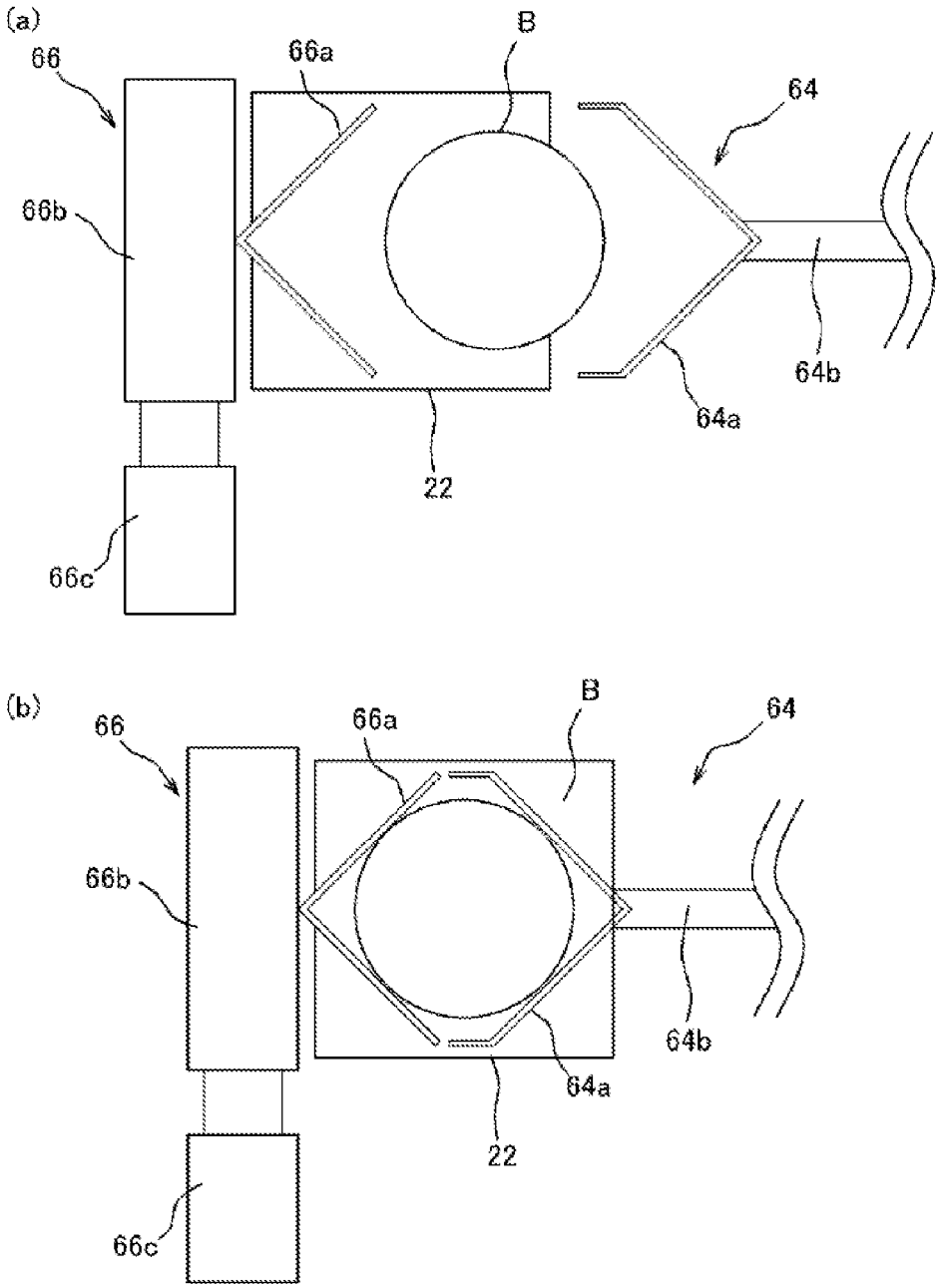
FIG. 10 is an explanatory diagram showing the schematic of the operation of transferring a vial bottle to a lifting table.

Regarding the bottle upright means 62, as shown in FIG. 10 (*a*) and FIG. 11(*a*), by operating the pressing piece 64*a* so as to be close to the bottle receiving unit 66*a* in the state wherein the bottle receiving unit 66*a* is substantially horizontal, it becomes possible to press the body of the vial bottle B that has been placed in an inclined state on the lifting table 22 from the side. By pressing the body of the vial bottle B with the pressing piece 64*a*, the vial bottle B can be manipulated to be in a substantially vertically standing state on the lifting table 22 as shown in FIG. 10(*b*) and FIG. 11(*b*). As shown in FIG. 11(*c*), by setting the bottle receiving unit 66*a* in the lifted state and operating the pressing piece 64*a* so as to move away from the bottle receiving unit 66*a*, the lifting table 22 can move in a vertical direction.

The bottle detection means 63 is installed at a position on the side of the bottle receiving means 66 described above, and is intended for detecting whether or not the vial bottle B is mounted on the sloping guide 61. The detection result of the bottle detection means 63 is used as the basis for operating the bottle upright means 62 described above.

As shown in FIG. 8, the labeling unit 70 is provided with a label printer 72 and pusher 74. The label printer is intended for pasting a label on the outer surface of the vial bottle B, and is provided at a location abutting the aforementioned supply means 60 on the front side 12*a* side.

Pusher 74 is intended for contacting the body section of the vial bottle B, which is waiting in a standing state on the lifting table 22, and to push the vial bottle B towards the label printer that is in front of the supply means 60. As shown in FIG. 8. the pusher 74 is located at a position lower than the bottle pressing means 64 described above, and is provided with four press rollers 74*a* for pressing the vial bottle B, a roller frame 74*b* pivoting these press rollers 74*a*, and a drive mechanism 74*c* to drive the roller frame 74*b* horizontally, more specifically, to move the roller frame 74*b* so as to move near to or move away from the vial bottle lifter 20.

Figure 12:
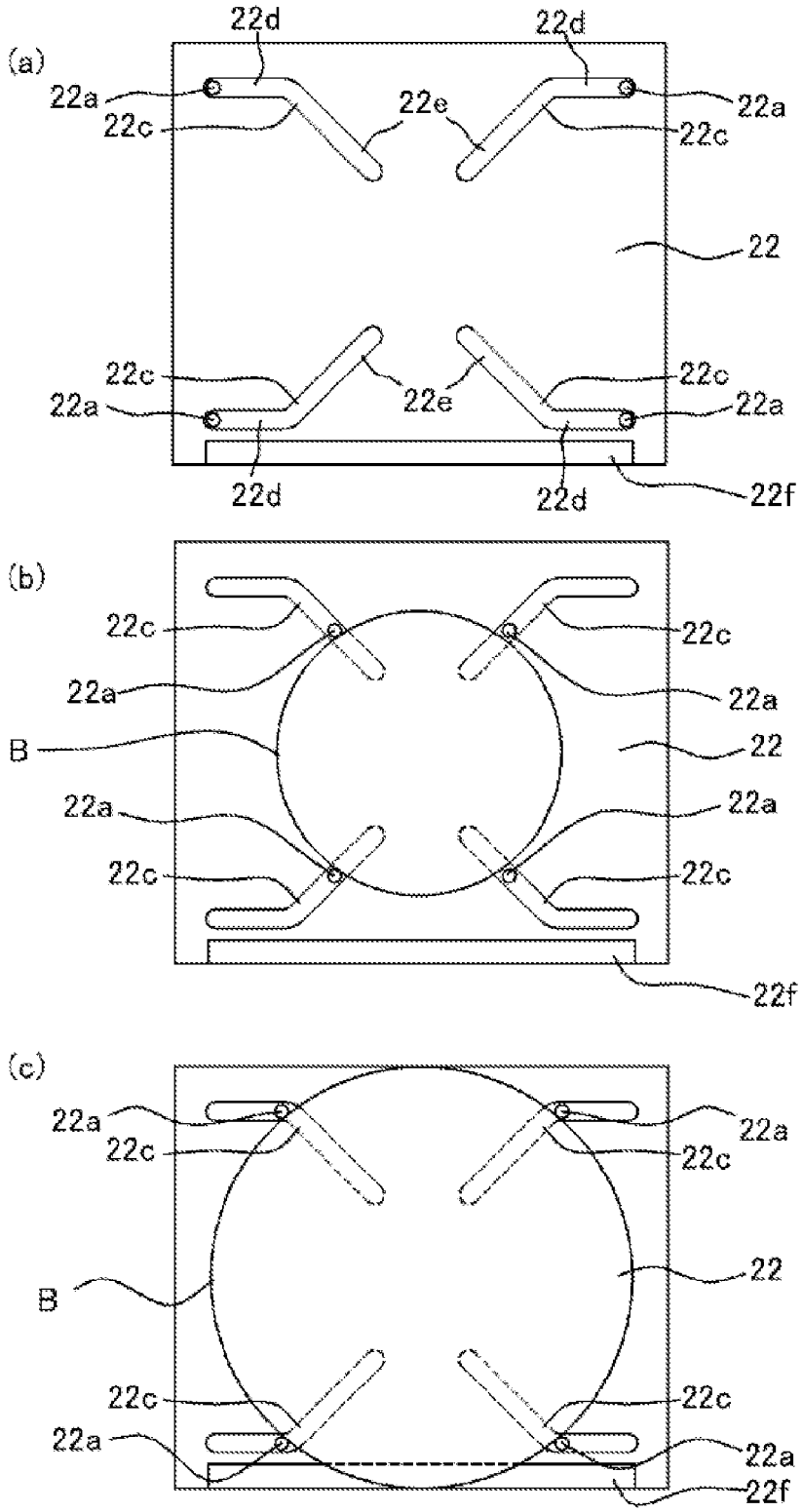
FIG. 12 (*a*) is an explanatory diagram showing the schematic of the structure of the lifting table, (*b*) and (*c*) are explanatory diagrams showing a state wherein a vial bottle is gripped by holding pins on the lifting table.

As shown in FIG. 6, the vial bottle lifter 20 is equipped with a lifting table 22 on which the vial bottle B supplied from the supply means 60 can be placed, and a lifting mechanism 26 for lifting and lowering this lifting table 22. The lifting table 22 is able to place the vial bottle B received from the first transfer means 54 of the delivery mechanism section 46 in approximately upright state, and move vertically in the space formed between the bottle pressing means 64 and bottle receiving means 66 described above. As shown in FIG. 12, the lifting table 22 is provided with four holding pins 22*a* (clamping pieces).

The holding pins 22*a* are intended to operate by receiving power from the drive mechanism (not shown), and as indicated by the arrows in FIG. 12(*a*), it is capable of reciprocating motion along four slits 22*c* provided in lifting table 22. Each slit 22*c* has been formed such that a part that is formed substantially linearly towards the substantially center from the outer edge of the lifting table 22 (roughly the center of gravity of lifting table 22), and a part extending in the width direction center from the width direction outer side along the outer edge of the lifting table 22 are formed so as to be continuous. That is, in the lifting table 22, a part in which 4 nos. of slits 22*c* are respectively formed radially (sloping sections 22*d*), and a part extending linearly along the outer edge of the lifting table 22 (straight sections 22*e*) are provided so as to be continuous.

In case a smaller size vial bottle B is mounted on the lifting table 22, each holding pin 22*a* enters the sloping section 22 after passing through the straight section 22*e*, and moves so as to converge toward the center of the lifting table 22, and therefore, the vial bottle B will become gripped in the bottom side (see FIG. 12 (*b*)). In case a large size vial bottle B is mounted on the lifting table 22, each holding pin 22*a* will bump against the vial bottle B in the course of passing through the straight section 22*e*, and the vial bottle B will become gripped in the bottom side. Therefore, the vial bottle lifter 20, regardless of the diameter of the vial bottle B mounted on the lifting table 22, will be able to firmly grip the vial bottle B and keep it with the help of the holding pins 22*a*. On the other hand, when each holding pin 22*a* moves along each slit 22*c* in a direction opposite to that mentioned above, the gripping force that was acting on the vial bottle B is released, and the vial bottle B will be released.

Moreover, the lifting table 22 has an inclined surface 22*f* at the edge on the side where the above-mentioned bottle guide means 60 is provided. The inclined surface 22*f* is the surface with which the bottom of the vial bottle B, which has been guided by the bottle guide means 60 and has come dropping obliquely, comes in contact (abutting), and the dropped vial bottle B can be stabilized. Also, as shown in FIG. 11, a sensor (bottle orientation detection means 23) is provided in the vicinity of the lifting table 22 to detect the bottom of the vial bottle B supported by contacting with the inclined surface 22*f*. Therefore, according to bottle orientation detection means 23, it is possible to discern whether or not a vial bottle B is supplied with the bottom orienting in the lower direction at the instant when it falls after being guided by the bottle guide means 60.

The lifting mechanism 26, as shown in FIG. 6, is installed in a location adjacent to the lifting table 22, and includes a guide rod 26*a* that can extend in upper and lower directions, and a lifting block 26*b* mounted on this. The lifting table 22 is further fixed to the lifting block 26*b* via an arm 26*c*. Therefore, if power is conveyed to the lifting block 26*b* from a power source (not illustrated), the lifting table 22 slides with the lifting block 26 in up and down directions along the guide rod 26*a*. If the lifting table 22 is moved in the upper direction, the vial bottle B placed on this lifting table 22 can be handed over to the transporting unit 80.

As shown in FIG. 1 and FIG. 2, the tablet supply unit 30 is on both sides 12*b* and 12*c* of the device body 12, and is provided at a location that is higher than where the above-mentioned vial bottle supply unit 40 and the like are provided. The tablet supply unit 30 includes a tablet cassette 32 from which the stored tablets can be removed. The medicine removed from the tablet cassette 32 is removed into the space between the tablet supply units 30 and 30 provided on both sides 12*b* and 12*c* of the device body 12.

In other words, the transporting unit 80 can move a vial bottle B, which is received from the above-mentioned vial bottle lifter 20, with its mouth facing the upper direction in the space between the tablet supply units 30 and 30 provided on both sides (sides 12*b* and 12*c*) of the device body 12. Therefore, by moving the vial bottle B with the help of the transport means 80 up to the withdrawal port (not shown) of the tablet cassette 32 containing the medicine to be filled, it will be possible to fill medicine in vial bottle B.

The transport unit 80 can convey the vial bottle B filled with tablets in the tablet supply unit 30 to the discharge unit 90. The vial bottle B conveyed to the discharge unit 90 can be retrieved by a user through the retrieval windows 14*a* to 14*c*.

The medicine filling device 10 of this embodiment features the operations involved from removing an empty vial bottle B from a stocker 42 up to supplying it via a supply means 60. Specifically, if the medicine filling device 10 is in state wherein medicine should be filled in the vial bottle B and supplied, the draw out means 50 and the transportation means 52 first operate, the vial bottle B is removed from the stocker 42, and transported towards the first transfer means 54. In this case, the first transfer means 54 adjusts the orientation of the frame 54*a* such that the transportation direction becomes substantially same as the transportation direction of the transportation conveyor 52*b* (receiving state), and sets the pulleys 54*b* and 54*c* in drive state. With this, the vial bottle B removed from the stocker 42 is drawn into the first transfer means 54 from the transportation means 52.

When the vial bottle B arrives at the first transfer means 54 side as mentioned above, the reversal mechanism 58 first operates, and the direction of the frame 54*a* is rotated by approximately 90° around the rotating shaft 58*a* (first dispatch state). With this, either the top surface or the bottom surface of the vial bottle B becomes oriented towards the sloping guide 61 of the bottle guide means 60, while the other side is oriented towards the bottle orientation detection means 56. In this state, the pulley 54*b* of the first transfer means 54 is slightly driven, and the vial bottle B is moved closer to the bottle orientation detection means 56. In this state, whether the bottom of the vial bottle B is oriented towards the bottle guide means 60 or not is detected by the bottle orientation detection means 56.

If it is confirmed by the bottle orientation detection means 56 that the vial bottle B is mounted on the first transfer means 54 with the bottom oriented towards the bottle guide means 60, the pulleys 54*b* and 54*c* are driven in the above-mentioned first dispatch state itself, and the vial bottle B is supplied to the bottle guide means 60. On the other hand, if it is confirmed that the vial bottle B is loaded on the first transfer means 54 in a state wherein the bottom is oriented towards the bottle orientation detection means 56, and if the pulleys 54*b* and 54*c* are driven as such in this state, the vial bottle B is supplied to the bottle guide means 60 in a state where the opening of the top end orienting down and the bottom orienting up. Thereupon, in such a case, the reversal mechanism 58 is driven, and the frame 54*a* is rotated by approximately 180° around the rotating shaft 58*a* (second dispatch state). When the pulleys 54*b* and 54*c* are driven in this state, the vial bottle B will be supplied to the bottle guide means 60 with the bottom oriented towards the top (downstream side in transportation direction of the first transfer means 54).

Here, as shown in FIG. 11(*a*), the timing of supplying the vial bottle B to the bottle guide means 60 as explained above is when the lifting table 22 of the vial bottle lifter 20 is already in a position adjacent to the sloping guide 61, and is waiting at a position slightly higher than the lower end of the sloping guide 61 (hereinafter also referred to as "standby position"). Therefore, if the vial bottle B is supplied from the first transfer means 54 to the bottle guide means 60, the vial bottle B will obliquely slide down with the bottom oriented downwards along the sloping guide 61, gets caught by coming in contact with the inclined surface 22*f* of the lifting table 22 that is waiting in the standby position, and stops.

When vial bottle B contacts the inclined surface 22*f*, whether the vial bottle B is supplied in a state with the bottom orienting in the lower direction or not is checked by the bottle orientation detection means 23 provided in the vicinity of the lifting table 22. Depending on the posture of the vial bottle B, the orientation of the bottom may not be detected by the bottle orientation detection means 23. In this case, the lifting table 22 is operated to move by a predetermined amount in the vertical direction, and the operation of detecting the bottom of the vial bottle B by the bottle orientation detection means 23 is performed again. Moreover, it is preferable that the stroke of the vertical movement of the lifting table 22 be set based on the smallest size of the vial bottle B that may be used so as to prevent problems such as the vial bottle B falling from the lifting table 22 in the process of vertical movement, and in this embodiment, it is in the range of about 10 mm to 15 mm.

If the orientation of the vial bottle B still cannot be detected despite repeating the operation of vertically moving the lifting table 22 as described above several times, an error is notified by a predetermined method. Further, even in a case where it is determined that the vial bottle B is supplied to the lifting table 22 with the bottom orienting upwards based on the result of detection operation by the bottle orientation detection means 23, an error is notified by a predetermined method. On the other hand, if it is confirmed by the bottle orientation detection means 23 that the vial bottle B is supplied with the bottom orienting downwards, the operation of the medicine filling device 10 will proceed to the next step as shown below.

If it is confirmed that by the bottle detection means 63 that the vial bottle B has arrived at the location contacting the lifting table 22, as shown in FIG. 11(*b*), the lifting table 22 will move in a direction lower than the standby location. In parallel with the movement of the lifting table 22 in the lower direction, the bottle upright means 62 is activated, and the body of the vial bottle B is pressed in the horizontal direction. With this, the vial bottle B, which was supported by the sloping guide 61 and contacted the lifting table 22 in an inclined state, will gradually become upright, and will be moved practically toward the center. More explicitly, the receiving unit driving means 66*b* of the bottle receiving means 66 is activated, the bottle receiving means 66*a* that was lifted up will assume a roughly horizontal posture as shown in FIG. 11(*a*), and will be in a state wherein the vial bottle B can be captured. In addition, the drive mechanism 64*b* of the bottle pressing means 64 is activated, and the pressing piece 64*a* will move substantially horizontally towards the vial bottle lifter 20 (towards bottle receiving portion 66*a*). Along with this, the pressing piece 64*a* will touch the body of the vial bottle B, and the vial bottle B is pushed towards the vial bottle lifter 20 (towards bottle receiving unit 66*a*). If the vial bottle B is pushed until it comes in contact with the bottle receiving portion 66*a*, the vial bottle B will be in a state where it is practically erect in the approximately middle of the lifting table 22.

When the vial bottle B is in a state of standing on the lifting table 22 as explained above, the vial bottle B will be in a state wherein the bottom is firmly gripped by the holding pins 22*a* provided in the lifting table 22. Subsequently, the lifting table 22 will move (descend) up to the location where the labeling unit 70 is provided. When the vial bottle B is moved up to a position facing the pusher 74 of the labeling unit 70, drive mechanism 74*c* is activated, the vial bottle B is pressed from the rear side 12*d* towards the front side 12*a* by pusher 74, and a label is pasted on the body of the vial bottle B by the label printer. Subsequently, the lifting mechanism 26 of the vial bottle lifter 20 is activated again, the lifting table 22 moves to the upper side of the device body 12, the vial bottle B is delivered to the transporting unit 80, and the vial bottle B that was empty is filled with prescribed medicine. When the filling of medicine to the vial bottle B is finished, this vial bottle B is moved to discharge unit 90 by the transporting unit 80, and can be taken out through the extraction window 14.

In the medicine filling device 10 of the present embodiment, by suitably activating the reversal mechanism 58 depending on the result of detection by the bottle orientation detection means 56, the vial bottles B can be supplied in a fixed orientation to the vial bottle lifter 20. Therefore, in the medicine filling device 10 of the present embodiment, randomly stored empty vial bottles B, regardless of any shape or size, can be supplied in fixed posture after being taking out from the stocker 42.

In the medicine filling device 10 of this embodiment, by making the vial bottle B that comes sliding down along the sloping guide 61 of bottle guide means 60 to contact with the edge of the lifting table 22 that is waiting in a predetermined standby location when a vial bottle B is handed over from the first transfer means 54 to the vial bottle lifter 20, the posture of the vial bottle B is momentarily stabilized, and by moving the lifting table 22 further in the downward direction or the like, the vial bottle B is stood practically erect on the lifting table 22. In this way, by performing the transfer of the vial bottle B to vial bottle lifter 20 from the first transfer means 54 in stages, it is possible to prevent the problems such as jumping of the vial bottle B that is unstable when empty to locations other than the lifting table 22, or overturning due to poor handing over or the like.

Moreover, in this embodiment, in consideration of the prevention of problems such as jumping of the vial bottle B to unexpected locations, the case of contacting the vial bottle B with the lifting table 22 that is waiting at a predetermined position was shown as an example of an example of temporarily stabilizing vial bottle B during the mounting of the vial bottle B on the lifting table 22 from the first transfer means 54. However, the present invention is not limited to this, and other configurations of mounting the vial bottle B on the lifting table 22 after temporarily stabilizing it by adopting other configurations may also be used. In cases where problems such as jumping or overturning of the vial bottle B do not have to be taken into account, a configuration of mounting the vial bottle B through a stage-wise process as described above is not necessarily required.

Moreover, in this embodiment, a bottle upright means 62 including a bottle pressing means 64 and bottle receiving means 66 is provided, and in the process of loading the vial bottle B to vial bottle lifter 20, along with lowering of the lifting table 22, by pressing and uplifting the body of the vial bottle B by pressing the body of the vial bottle B that is slantingly contacting with the lifting table 22 of the vial bottle lifter 20 with the bottle pressing means 64 from a side, and by catching the vial bottle B with the bottle receiving means 66 in the opposite side across the vial bottle B, the standing on the lifting table 22 has been made possible. Therefore, a vial bottle B that is supplied obliquely via the bottle guide means 60 can be further ensured to be in the standing state on the lifting table 22.

Figure 14:
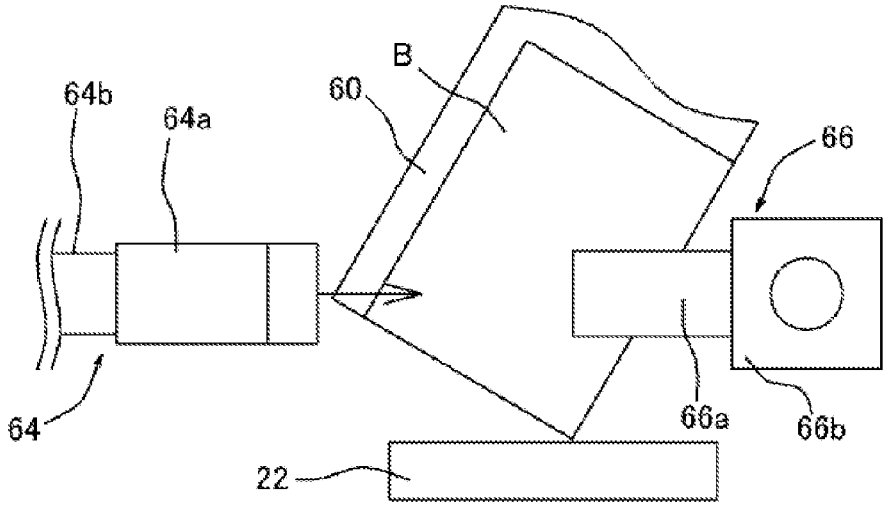
FIG. 14 is a schematic diagram showing a modified example of the bottle upright means.
Figure 14:
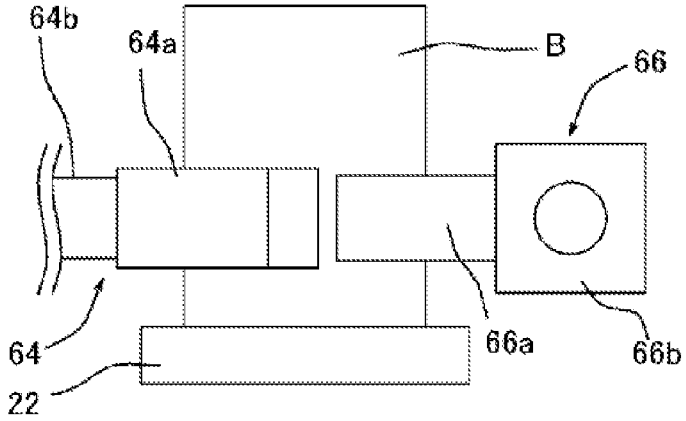

Moreover, in this embodiment, the example of pressing and uplifting the vial bottle B by operating the pressing piece 64*a* of the bottle pressing means 64 in a substantially horizontal direction in the lower side of the vial bottle B in an inclined state was illustrated, but the present invention is not limited to this. More specifically, as shown in FIG. 14, by operating the pressing piece 64*a* in a state where the positional relationship between the bottle pressing means 64 and bottle receiving means 66 is reversed, it is possible to set the vial bottle B in a substantially standing state by supporting the inclined vial bottle B from the lower side by the bottle receiving means 66 as well as also enabling pressing of the body of this vial bottle B with the bottle pressing means 64. In addition, in case of a configuration shown in FIG. 14, it is preferable to arrange the bottle guide means 60 or the like such that the vial bottle B guided by the bottle guide means 60 will come in contact at a location closer to the bottle pressing means 64 side than the example shown in FIG. 11 so as to enable the vial bottle B to descend at approximately at the center of the lifting table 22 by the pressing with the bottle pressing means 64.

As described above, the lifting table 22 of the vial bottle lifter 20 is designed to grip the vial bottle B that was transferred onto the lifting table 22 with the help of multiple (four) holding pins 22*a* so as to facilitate reciprocating movement in the path from the outer edge towards the center. Therefore, in the medicine filling device 10, regardless of the size of the vial bottle B and the like, a vial bottle B can be gripped firmly by the holding pins 22*a*.

In the present embodiment, an example was shown a configuration of gripping the vial bottle B by moving the holding pins 22 linearly along the four slits 22 that are formed in a diagonal shape in a rectangular shaped lifting table 22, but the present invention is not limited to this, and other configurations for gripping or supporting vial bottle B are also possible. Also, it is not necessary that the operation of holding pins 22, shape of slits 22 and the like be linear, and may also be curved, bent, or the like. Also, in this embodiment, holding pins 22 were illustrated as an example of a member for gripping the vial bottle B, but it is not limited to the pin shape, and it is possible to be in an appropriate shape such as a block shape or the like.

Figure 16:
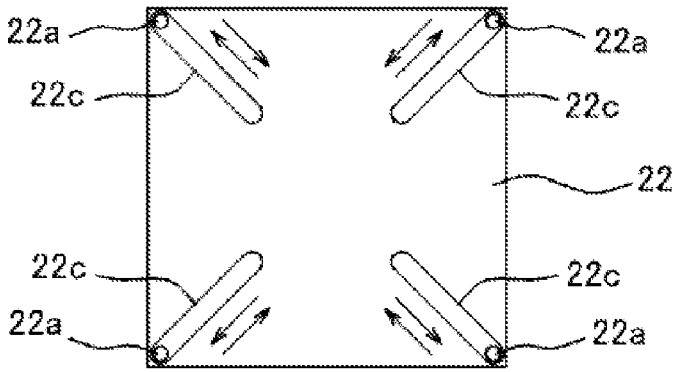
FIG. 16 (*a*) is an explanatory diagram schematically showing the structure of a modified example of the lifting table, (b) and (c) are explanatory diagrams showing a state wherein a vial bottle is gripped by holding pins on the lifting table.
Figure 16:
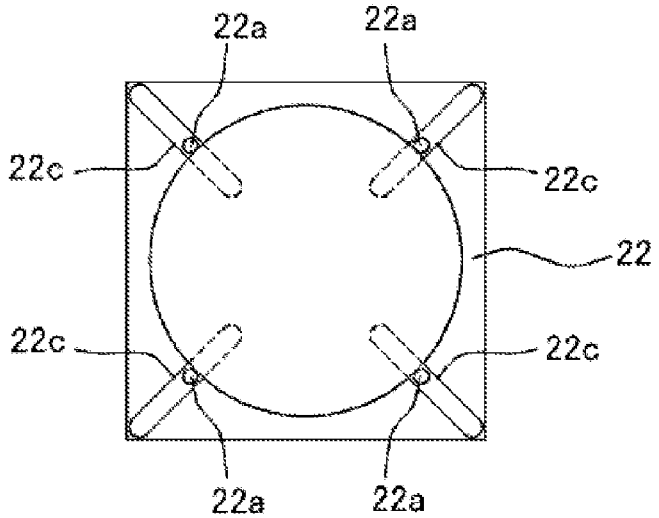
Figure 16:
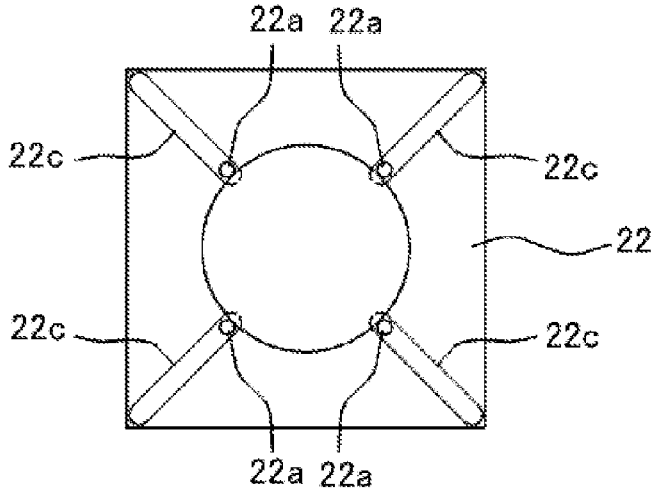

In this embodiment, although an example was illustrated in which slits 22*c* having a sloping section 22*d* and a straight section 22*e* that are continuous and curved are provided on the lifting table 22, the present invention is not limited to this, and, for example, an embodiment is also possible as shown in FIG. 16 in which slits 22*c* include only a section that extends in an oblique direction toward the center from the outer edge of the lifting table 22 in the same manner as the sloping section 22*d*. In such a configuration, although a large size vial bottle B cannot be gripped because of the absence of a part corresponding to straight section 22*e*, it is possible to firmly grip the vial bottle B on the bottom side regardless of the diameter similar to that shown in this embodiment.

DESCRIPTION OF REFERENCE CHARACTERS

10 Medicine filling device
20 Vial bottle lifter (second transportation means)
22 Lifting table (bottle mounting section)
22*a* Holding pin (clamping piece)
22*c* Slit
22*d* Sloping section
22*e* Straight section
22*f* Inclined surface
23 Bottle orientation detection means (the second bottle orientation detection means)
22*a* Holding pin (clamping piece)
30 Tablet supply unit (medicine filling unit)
42 Stocker (bottle storage unit)
54 First transfer means
56 Bottle orientation detection means
58 Reversal mechanism
60 Bottle guide means

The invention claimed is:

1. A medicine filling device comprising:
a bottle storage unit for randomly storing empty vial bottles comprising an open top end and a bottom end;
a medicine filling unit for filling the empty vial bottles with medicine;
a first transfer means for transporting at least one empty vial bottle stored in the bottle storage unit in an overturned state;
a second transfer means for maintaining the at least one empty vial bottle transported from the first transfer means in an upright state, and for transporting it toward the medicine filling unit;
a bottle orientation detection means for detecting an orientation of the at least one empty vial bottle taken from the bottle storage unit to the first transfer means; and
a reversal mechanism for reversing an orientation of the at least on empty vial bottle in the first transfer means based on a result of detection obtained by the bottle orientation detection means,
wherein the at least one empty vial bottle is supplied from the first transfer means to the second transfer means such that the bottom end is oriented in a predetermined direction.

2. The medicine filling device according to claim 1, further comprising
a bottle guide means for guiding the at least one empty vial bottle transported by the first transfer means in an inclined downward direction, said bottle guide means is provided between said first and second transfer means; and
a bottle mounting section provided in the second transfer means for mounting the at least one empty vial bottle,
wherein the at least one empty vial bottle is supplied from the first transfer means to the second transfer means in a state where the bottom end is oriented towards a traveling direction of the first transfer means, and
wherein after the at least one vial bottle obliquely contacts the bottle mounting section of said second transfer means, which is waiting in a predetermined standby position, said second transfer means moves to a lower side by a predetermined amount from said standby position.

3. The medicine filling device according to claim 2, wherein a bottle pressing means for pressing a body of the at least one empty vial bottle is provided, said body of the at least one empty vial bottle is obliquely in contact with the bottle mounting section of the second transfer means which is waiting in a predetermined standby position from one side, wherein a bottle receiving means for supporting the body of the at least one empty vial bottle pressed by said bottle pressing means is provided at an opposite side of said bottle pressing means across the at least one empty vial bottle, and wherein the body of the at least one empty vial bottle is pressed by the bottle pressing means after the at least one empty vial bottle obliquely contacts the bottle mounting section of the second transfer means, which is waiting in a predetermined standby position.

4. The medicine filling device according to claim 2, wherein said second transfer means is provided with a plurality of clamping pieces that are capable of reciprocating movement in a path toward a center from an outer edge of the bottle mounting section, and wherein after the at least one empty vial bottle is transported from said first transfer means to said bottle mounting section, said clamping pieces respectively move towards a center of said mounting section, and the at least one empty vial bottle is gripped by said clamping pieces.

5. The medicine filling device according to claim 4, wherein the plurality of clamping pieces are provided for gripping the at least one empty vial bottle loaded on said bottle mounting section and a plurality of slits that guide said clamping pieces, and wherein the plurality of slits are formed such that a straight section extending in a width direction from an outer edge of said bottle mounting section and a sloping section, which is continuous with said straight section, extending in an oblique direction towards a center from the outer edge of said bottle mounting section.

6. The medicine filling device according to claim 5, wherein an outer edge of said bottle guide means in the bottle mounting section is provided with an inclined surface which comes in contact with the bottom end of the at least one empty vial bottle descending via said bottle guide means.

7. The medicine filling device according to claim 6, wherein a second bottle orientation detection means for detecting an orientation of the at least one empty vial bottle is provided at a diagonally downward location with respect to a location at which said bottle mounting section contacts said at least one empty vial bottle, and wherein using an error status based upon a detection operation of said second bottle orientation detection means, the bottle mounting section moves in a vertical direction by a predetermined amount, to cause again execution of said detection operation by the second bottle orientation detection means.

* * * * *